US006470649B2

(12) United States Patent
Usui et al.

(10) Patent No.: US 6,470,649 B2
(45) Date of Patent: Oct. 29, 2002

(54) PALLET AND LOAD PACKAGING METHOD

(75) Inventors: Takayuki Usui, Shizuoka-ken (JP); Takehiro Sone, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/983,911

(22) Filed: Oct. 26, 2001

(65) Prior Publication Data

US 2002/0023412 A1 Feb. 28, 2002

Related U.S. Application Data

(62) Division of application No. 09/418,994, filed on Oct. 14, 1999, now Pat. No. 6,332,535.

(30) Foreign Application Priority Data

Oct. 16, 1998 (JP) ..... 10-295139

(51) Int. Cl.[7] ..... B65B 11/58
(52) U.S. Cl. ..... 53/449; 53/416; 206/386
(58) Field of Search ..... 53/449, 416; 108/51.3; 206/386

(56) References Cited

U.S. PATENT DOCUMENTS 3,618,755 A * 11/1971 Kean et al. ..... 206/454
3,626,860 A 12/1971 Blatt ..... 108/58
4,027,794 A * 6/1977 Olson ..... 206/395
4,044,981 A * 8/1977 Richter ..... 206/386
4,171,741 A * 10/1979 Fish ..... 206/335
4,445,614 A 5/1984 Mitsumori et al. ..... 206/599
4,966,084 A * 10/1990 Motomaru ..... 108/51.3
5,503,085 A 4/1996 Rozek ..... 108/51.3
5,672,412 A 9/1997 Phares et al. ..... 428/182

FOREIGN PATENT DOCUMENTS

EP 0 334 329 A2 9/1989 ..... B65D/19/26
EP 0 494 540 A2 7/1992 ..... B65D/19/34

* cited by examiner

*Primary Examiner*—Scott A. Smith
*Assistant Examiner*—Nathaniel Chukwurah
(74) *Attorney, Agent, or Firm*—Sughrue Mion., PLLC

(57) ABSTRACT

A pallet includes a loading member made from paper onto which a load is loaded; leg members made from paper which are fixed to the loading member and, as well as supporting the loading member when a load is loaded on the loading member, form an insert body receiving member into which is inserted an insert body used during transportation; and a base member made from paper which is fixed to the opposite side of the leg members to the loading member. A load is loaded onto the loading member of this type of pallet and is intermediately packaged with intermediate packaging material in a process including a load loading step for loading the load onto the loading member; and a fastening step for fastening the intermediate packaging material with which the load was intermediately packaged in the intermediate packaging step to the loading member.

6 Claims, 13 Drawing Sheets

PALLET AND LOAD PACKAGING METHOD

This is a divisional of application Ser. No. 09/418,994 (Confirmation No. Unknown) filed Oct. 14, 1999, now U.S. Pat. No. 6,332,535, the disclosure of which is incorporated herein by reference.

BACKGROUND OF THE INVENTION

1. Field of the Invention

The present invention relates to a pallet on which a load is loaded and then transported or stored and a load packaging method for loading and packaging a load loaded on the pallet.

2. Description of the Related Art

A conventional pallet used for the transport and storage etc. of goods is normally a general purpose item made from wood or metal and formed without consideration given to the shape of the load to be loaded on the pallet.

The transport and storage of photosensitive printing plates will be described as an example. When a large quantity of photosensitive printing plates are packaged (for example, 250~1500 plates per one package) and transported, the photosensitive printing plates which are manufactured in a factory are placed in stacks of a predetermined number and intermediately packaged. The intermediately packaged photosensitive printing plates are then stacked on general use pallets made of wood or metal and externally packaged, and are then transported or stored. In some cases, the photosensitive printing plates are also stacked directly on the pallets and then externally packaged before being transported or stored.

However, general use pallets made of wood or metal are expensive due to the material costs and the labor required for their manufacture. Moreover, these pallets are heavy and difficult to handle during transport or storage. Furthermore, disposal of the wood or metal forming the pallet is difficult and pallets are sometimes left to accumulate at their destination after being transported.

In addition, because general use pallets are used which are made without consideration given to the shape of the load, positioning and fastening of the load when loading the pallets have been difficult.

On the other hand, when a small quantity of photosensitive printing plates are packaged (for example, 10~100 plates per package) and transported, units of stacked and intermediately packaged photosensitive printing plates are further placed in corrugated fiberboard boxes, which are then packaged and transported etc.

However, if corrugated fiberboard boxes are used, it is necessary to perform the time-consuming task of opening each corrugated fiberboard box one by one when the photosensitive printing plates are to be used. Moreover, because the empty corrugated fiberboard boxes end up as waste material at their destination, a great deal of waste materials are generated particularly after a large quantity of photosensitive printing plates have been transported.

SUMMARY OF THE INVENTION

In consideration of the above, the aim of the present invention is to provide a pallet which is inexpensive and easy to handle during transport or storage and a load packaging method in which a load can be easily loaded on this pallet and packaged.

The first aspect of the present invention is a pallet comprising: a loading member made from paper onto which a load is loaded; a leg member made from paper which is fastened to the loading member and, as well as supporting the loading member when a load is loaded on the loading member, forms an insert body receiving member into which is inserted an insert body used during transportation; and a base member made from paper which is fixed to the opposite side of the leg member to the loading member.

Accordingly, when a load has been loaded onto the loading member, the insert body is inserted into the insert body receiving member which is formed by the leg member, and the pallet and load are able to be transported. The insert body named here may be any member provided that the pallet becomes transportable by inserting the insert body into the insert body receiving member. An example of the insert body is the forks of a fork lift, however, the insert body is not limited to this and other examples include an elongated bar which may be inserted as an insert body into the insert body receiving member and the portion of the bar which protrudes from the pallet lifted and pushed sideways, thus allowing the pallet and load to be transported.

Because the loading member, the leg member, and the base member which form the pallet are all made from paper, the pallet is lighter than comparable pallets made from metal or resin, and handling the pallets during transport or storage is easier. Furthermore, used pallets are easily disposed of at their destination. Naturally, when the pallets are still capable of being reused (i.e. when their strength and shape as pallets are preserved), they may be reused. Moreover, even when they are not capable of being reused, because the pallets are made from paper, they can be easily recycled. In addition, by manufacturing the pallets out of paper, the manufacturing costs can be kept down.

The paper which is used as the material for the loading member, the leg member, and the base member, is not particularly limited, and any material which has a certain strength and can maintain the shape of the pallet and support the weight of the load is acceptable. For example, general corrugated fiberboard, honeycomb structure materials made from paper, cardboard, Kraft paper and the like may be used. Moreover, the general corrugated fiberboard, honeycomb structure materials made from paper, cardboard, Kraft paper and the like may be laminated to produce an even stronger material which can also be used. Each of the loading member, the leg member, and the base member may also be made out of different types of paper.

Because the leg member is fastened to the loading member, manufacturing of the pallet is simplified. There is no particular limit as to the number of leg members. For example, a plurality of leg members may be provided with predetermined gaps formed therebetween which gaps act as insert body receiving members. Thus insert body receiving members can be provided by a simple structure.

When a plurality of leg members are provided, the plurality of leg members are fixed from two sides by the loading member and the base member and are thus able to more securely support the loading member. Moreover, when a plurality of pallets each with a load loaded thereon are stacked on top of each other, the base plate portion directly above the top surface of a load makes surface contact with the top surface of the load so that the weight on the load is distributed and the load is not damaged or deformed. This enables handling to be simplified.

In the present invention, the loading member is preferably constructed by superposing more sheets of paper than are used to construct the base.

This causes the strength of the loading member to be greater than that of the base member. Accordingly, when a pallet with a load loaded thereon is lifted or moved, deformation of the loading member and deformation or shifting of the load can be prevented.

In the present invention, the loading member is preferably constructed by superposing a plurality of sheets of paper in such a manner that the grain of at least one sheet of the paper forming the loading member intersects the direction of the grain of the other sheets of paper forming the loading member.

By making the direction of the grain of the sheets of paper forming the loading member intersect in this way, unevenness in the strength of the loading member depending on the direction can be reduced. Accordingly, when, for example, the insert body is inserted for transporting, a fixed level of strength can be maintained no matter which direction the insert body is inserted from. Thus, deformation of the loading member and deformation or shifting of the load can be prevented.

In the present invention, the leg member is preferably hollow.

Accordingly, the leg member is light in weight which simplifies handling during transporting and storage. Moreover, because the actual amount of paper needed to construct the leg member is reduced, the leg member can be formed at a lower cost allowing the pallet as a whole to be manufactured cheaply.

Note that the leg member is not particularly limited to a hollow leg member. For example, a hollow leg portion may be formed by stacking a plurality of sheets of paper side on to each other to form a side wall of a leg member and fixing a plurality of the side walls in a predetermined layout. However, a single sheet of paper may be bent and rolled up in a coil to form a cylindrical shape (a round cylinder, four sided cylinder, or three sided cylinder). By forming the leg member from a single sheet of paper in this way, the number of parts is reduced and the manufacturing of the leg is simplified.

In the present invention, the loading member is preferably provided with an extending portion which extends outwards further than the load which is loaded onto the loading member.

Because of this extending portion, even if another member strikes against the pallet during transport or storage, this other member strikes against the extending portion and not against the load, thus allowing the load to be protected and simplifying handling.

In the present invention, the loading member preferably has a step portion provided with a peripheral portion which is flush with the side surfaces of the load when a load is loaded on the loading member.

Accordingly, when a load is loaded onto the step portion, the side surfaces of the load are flush with the peripheral portion of the step portion. An intermediate packaging material is placed in surface contact with the side surfaces of the load and the peripheral portion of the step portion thus intermediately packaging the load and the step portion as a single body. This allows the intermediate packaging material to be fixed by the step portion and the load to then be fixed by the intermediate packaging material. Because this structure prevents the load from shifting the position on the loading member, handling during transporting and storage are simplified.

In the present invention, the extending portion is preferably formed so as to bend the loading member towards the load at a position further from the outer edge portion of the load loaded onto the loading member than the thickness of the intermediate packaging material with which the load is intermediately packaged.

In this pallet, the bend of the extending portion may be made in advance before the load is loaded on the loading member or may be made after the load has been loaded and packaged with the intermediate packaging material.

If the bend is made in advance, the load and intermediate packaging can be easily positioned on the loading member.

If the bend is made after the intermediate packaging has been applied, because it is sufficient if the bend is made along the outer edge of the load (or intermediate packaging), the task is simplified. It is also possible to apply the intermediate packaging, then the external packaging, then to bend the extending member from outside the external packaging.

In whichever case, the bent portion after being bent contacts the load and the load is unable to shift position on the loading member, therefore, handling during transporting and storage is simplified.

Note that the position where the loading member is bent is not limited provided it is at a position outside the thickness of the intermediate packaging material. For example, the bend may be made at a position outside the combined thickness of the intermediate packaging material and the external packaging material.

In the present invention, a housing portion is preferably formed in the loading member which houses a transporting member for transporting the load, and is able to allow the transporting member to be removed when the load has been loaded on the loading member by the transporting member.

The transporting member mentioned here may be any member provided that it is able to transport a load before that load is loaded on a loading member. Examples include the forks of a forklift and an accumulating arm which accumulates a load on the load production line and transports it.

When the load is supported by the transporting member, transported to the loading member and placed on the loading member, the transporting member is housed in the housing portion. Therefore, the transporting member does not get caught between the loading member and the load. Once the load is loaded on the loading member, the transporting member can be removed from the housing portion thus simplifying the task of loading the load onto the loading member.

The second aspect of the present invention is a load packaging method in which a load is loaded onto a loading member of a pallet and is intermediately packaged with intermediate packaging material comprising the following steps: a load loading step for loading the load onto the loading member; an intermediate packaging step for intermediately packaging the top surface and side surfaces of the load loaded onto the loading member with the intermediate packaging material; and a fastening step for fastening the intermediate packaging material with which the load was intermediately packaged in the intermediate packaging step to the loading member.

In this way, after the load has been loaded on the loading member, the load can be easily intermediately packaged simply by intermediately packaging the load with the intermediate packaging material and fastening this intermediate packaging material to the loading member. There is no particular limitation as to the intermediate packaging material, however, by using paper with excellent moisture proof properties or paper with excellent light proof properties, the load can be given general protection from moisture and light.

There is no particular limitation either as to the fastening means for fastening the intermediate packaging material to the loading member and adhesive tape or bond, for example, may be used. However, using adhesive tape makes the adhering task easier.

In the present invention, before the step to load a load on a loading member, a laying step is preferably performed to lay intermediate packaging material, which is substantially the same shape as the loading member, on the loading member.

In this way, by laying intermediate packaging material on the loading member, intermediate packaging material is disposed on the bottom surface of the load as well. Therefore, when moisture proof and light proof paper are used for the intermediate packaging material, the ability to protect the load from moisture and light can be increased.

The second aspect of the present invention is a load packaging method for loading a load onto a loading member of a pallet according to the first aspect of the present invention and packaging the load preferably comprising: a laying step for laying a lower intermediate packaging material formed to a larger size than the loading member on the loading member; a lower intermediate packaging step for loading a load onto the lower intermediate packaging material laid in the laying step and for bending upwards portions of the lower intermediate packaging material which extend out beyond the load thus intermediately packaging the bottom surface and a portion of or all of the side surfaces of the load; and a fastening step for intermediately packaging the top surface and side surfaces of the load loaded onto the loading member with an upper intermediate packaging material and fastening the upper intermediate packaging material to the lower intermediate packaging material.

In this way, by laying the lower intermediate packaging material on the loading member, intermediate packaging material is disposed on the bottom surface and side surfaces of the load. Then in the fastening step, by intermediately packaging the top surface and side surfaces of the load with upper intermediate packaging material and fastening this to the lower intermediate packaging material, the external surfaces of the load can be completely intermediately packaged. Therefore, when light proof and water proof paper is used for the intermediate packaging, the ability to protect the load from moisture and light can be increased.

In the load packaging method of the second aspect of the present invention using a pallet of the first aspect of the present invention, preferably, in the step to load the load on the loading member, the side surfaces of the load and the side portions of the step are made flush, and in the intermediate packaging step, the intermediate packaging material is placed in surface contact with both the side surfaces of the load and the side portions of the step.

Accordingly, when the intermediate packaging material is placed in surface contact with the side surfaces of the load and the side portions of the step when both the side surfaces of the load and the side portions of the step are flush with each other, the load and the step can be intermediately packaged as one body. Because the intermediate packaging material is fixed by the step and the load is further fixed by the intermediate packaging material, there is no shifting in the position of the load on the loading member and handling during transport and storage are simplified.

The present invention is a load packaging method using the pallet of the first aspect of the present invention, wherein, preferably, in the laying step, lower intermediate packaging material is laid while the extending portion is not bent, and in the lower intermediate packaging step, the lower intermediate packaging material and the extending portion are bent upwards.

Namely, because the extending portion is bent after the load has been packaged with the intermediate packaging material, the extending portion does not become a hindrance when the load is loaded and the task of loading is simplified.

Note that, in the lower intermediate packaging step, the lower intermediate packaging material may be bent first and the extending portion bent after that. However, the lower intermediate packaging material and the extending portion may be bent as one material. If the two are bent as one, in this way, the number of steps is decreased and the task of bending is simplified.

DESCRIPTION OF THE PREFERRED EMBODIMENTS

Figure 1:
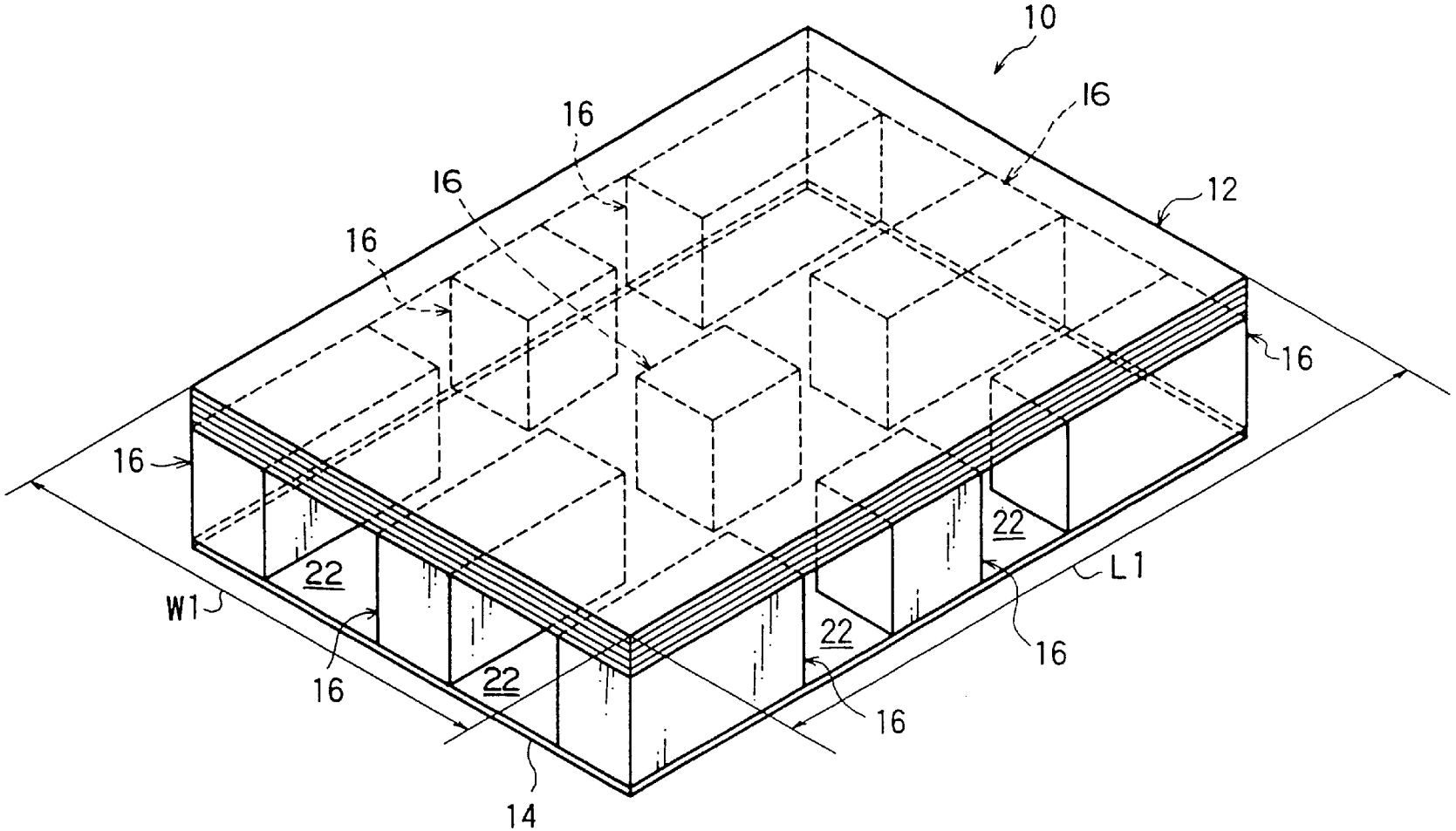
FIG. 1 is a perspective view showing a pallet according to the first embodiment of the present invention.
Figure 13:
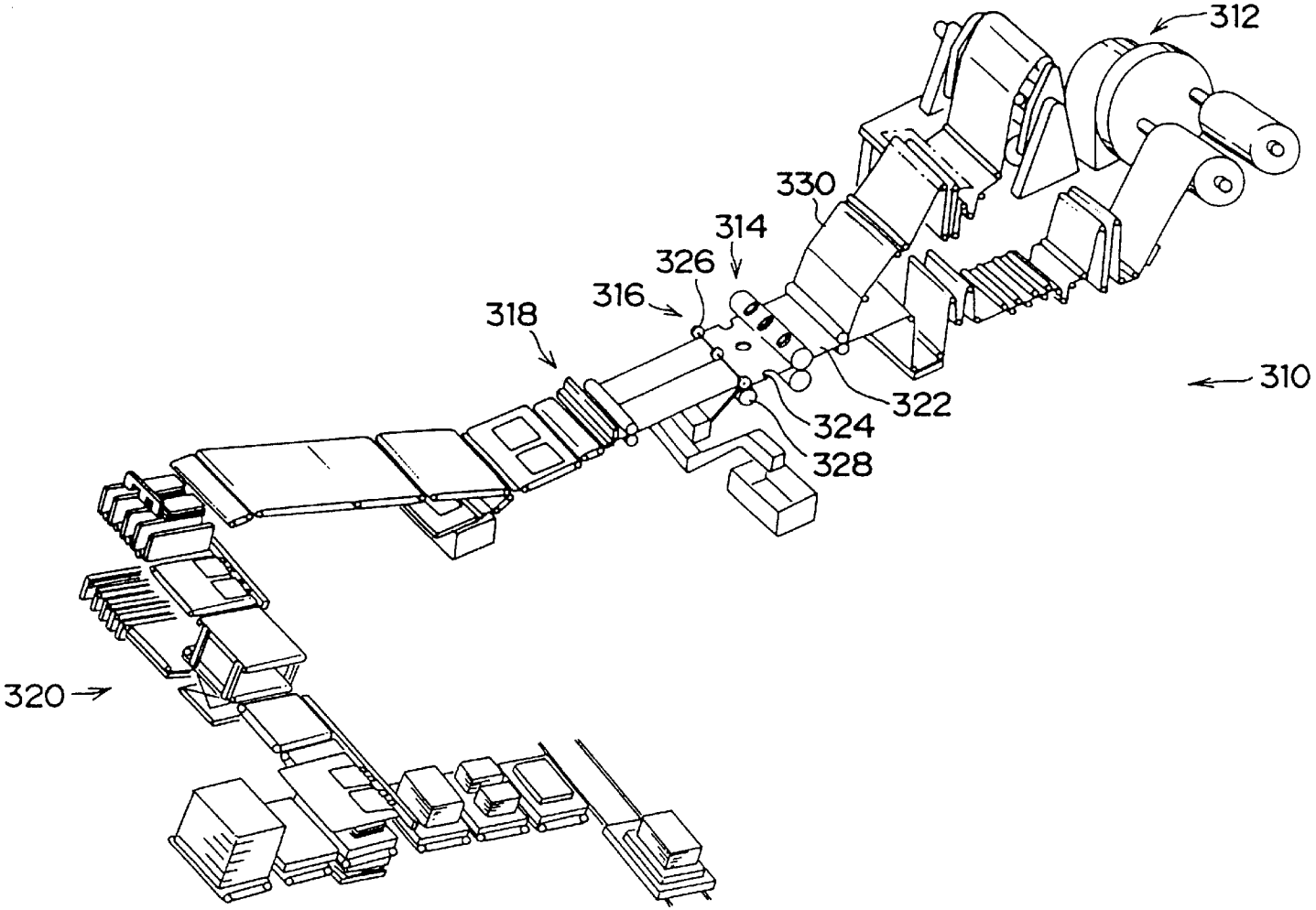
FIG. 13 is a perspective view schematically showing a production line for photosensitive printing plates to be loaded onto a pallet of the present invention.

FIG. 1 shows a pallet 10 according to the first embodiment of the present invention. FIG. 13 schematically shows a production line 310 for photosensitive printing plates which are to be loaded onto the pallet 10 and then transported, stored, or the like. Note that, in the description below, photosensitive printing plates are used as the example of the load on the pallet 10, but the present invention may also be applied to heat sensitive printing plates.

A feeding mechanism 312, a notcher 314, a slitter 316, flying shears 318, and an accumulating apparatus 320 are disposed in that order going from the upstream side (top right side of FIG. 13) to the downstream side (bottom left side of FIG. 13) of a production line 310.

Web 322, in the form of a roll, is fed into the feeding mechanism 312 where a plurality of webs 322 are joined together in sequence to form an elongated web. Backing paper 330 transported from another line is adhered to the web 322, which is fed out from the feeding mechanism 312, which proceeds to the notcher 314.

The notcher 314 makes partial notches including in both ends of the web 322 in the transverse direction thereof, to form so-called ear portions 324. The web 322 is then trimmed to a predetermined width by a trimming upper blade 326 and a trimming lower blade of the slitter 316. Because the trimming upper blade 326 and the trimming lower blade 328 of the slitter 316 enter into the ear portions 324, they are able to move in the transverse direction of the web 322. Therefore, while continually making cuts, the trimming width of the web 322 (the width cut by the slitter 316) can be altered.

In this way, the web 322, which has a predetermined trimming width, is cut to a predetermined length by the flying shears 318, thus producing a photosensitive printing plate of the desired size.

In the accumulating apparatus 320, a plurality of photosensitive printing plates, to which is adhered the backing paper 330, are accumulated (accordingly, the photosensitive printing plates and the backing paper 330 are alternately superposed), thus forming a stack 112 (see FIG. 3) of photosensitive printing plates.

Figure 3:
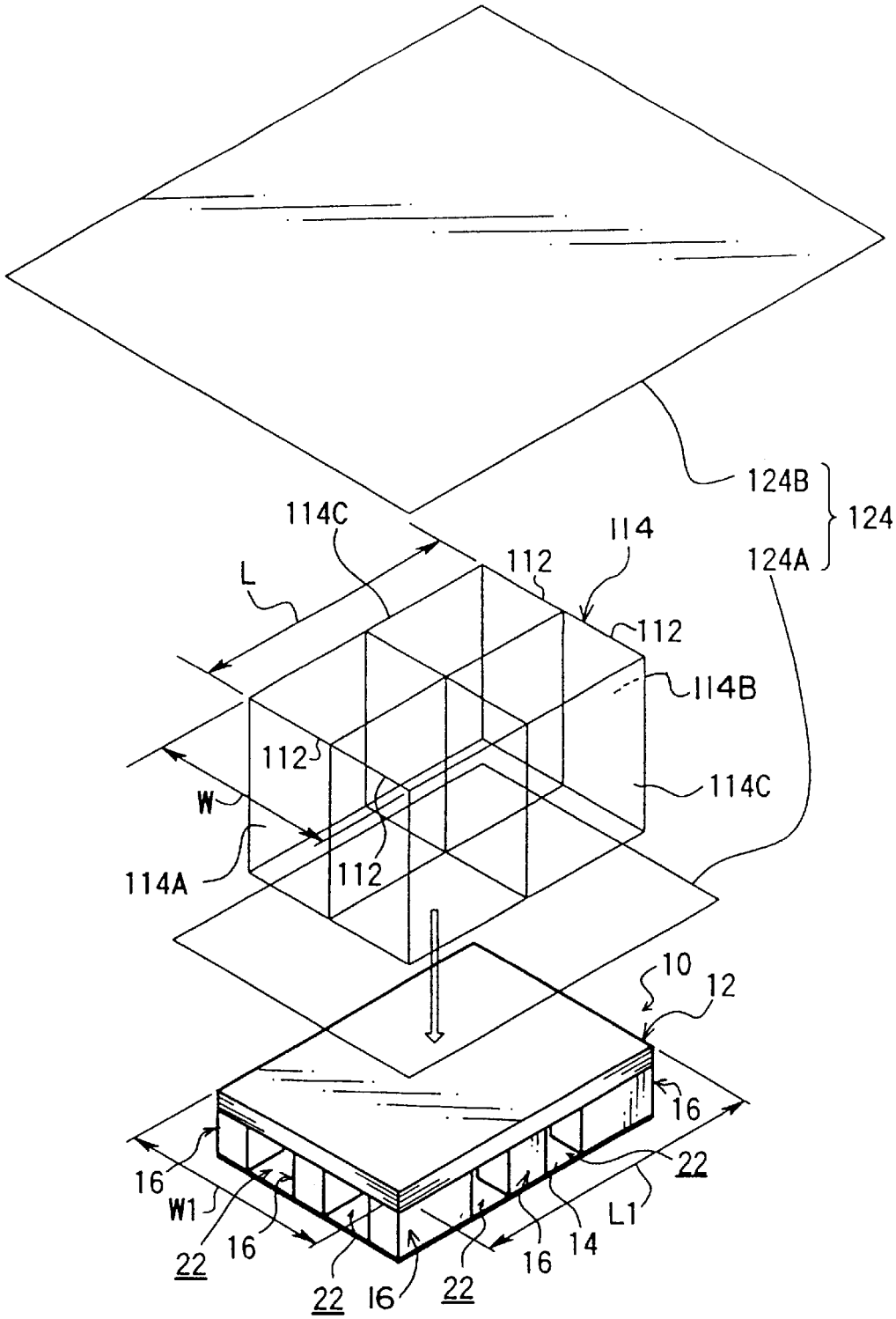
FIG. 3 is a perspective view showing a pallet according to the first embodiment of the present invention and a load unit and intermediate packaging material loaded on this pallet.
Figure 4:
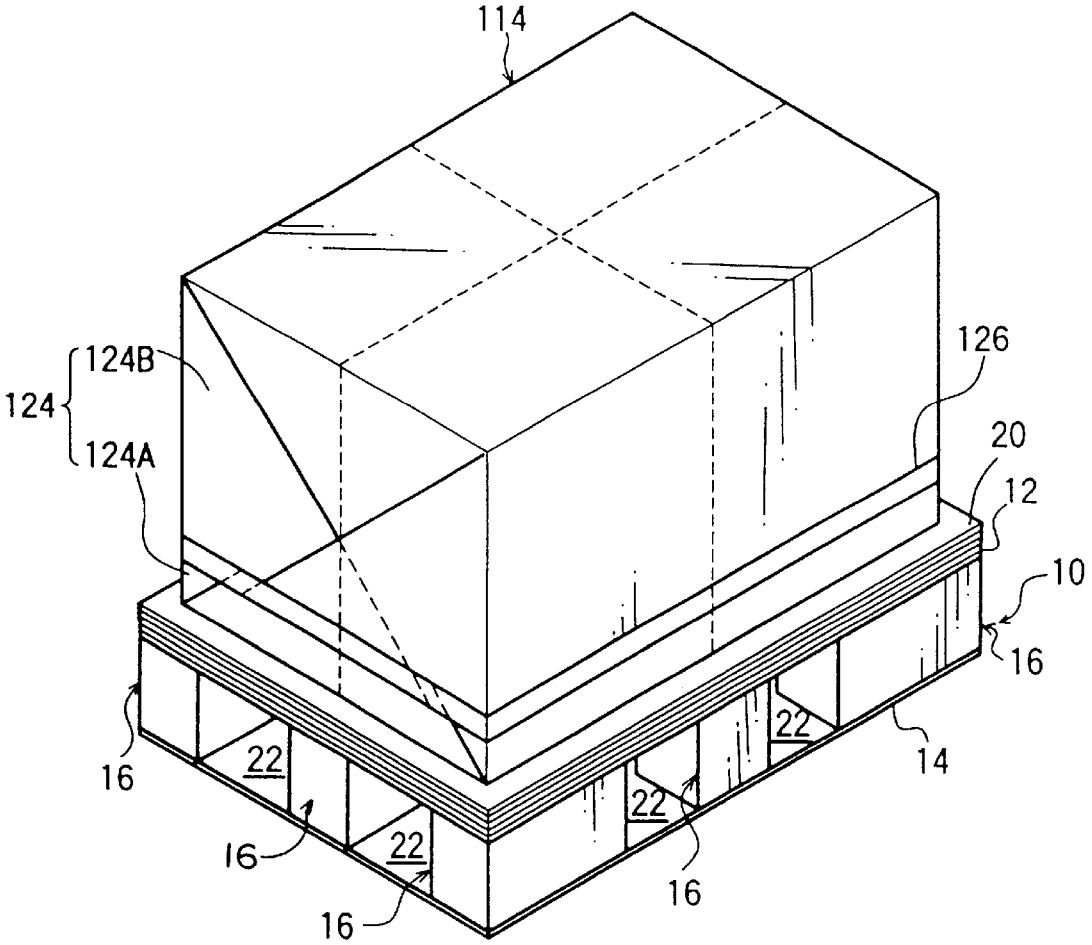
FIG. 4 is a perspective view showing a load unit which has been loaded on a pallet according to the first embodiment of the present invention and intermediately packaged using intermediate packaging material.

When the stack 112 is sent further along the production line 310, as is shown in FIG. 3, a load unit 114 is formed as a single load from one stack 112 or a plurality of stacks 112 loaded onto a single pallet 10 (the examples in FIGS. 3 and 4 show a load unit 114 formed from four stacks 112 lined up two abreast in both the longitudinal and transverse directions loaded onto a pallet).

As is shown in FIG. 1, the pallet 10 is formed from a loading tray 12, onto which stacks of photosensitive printing plates 112 are loaded, a base plate 14 which is disposed parallel to the loading tray 12, and a plurality (nine in the present embodiment) of leg portions 16, which are disposed between the loading tray 12 and the base plate 14.

Figure 2:
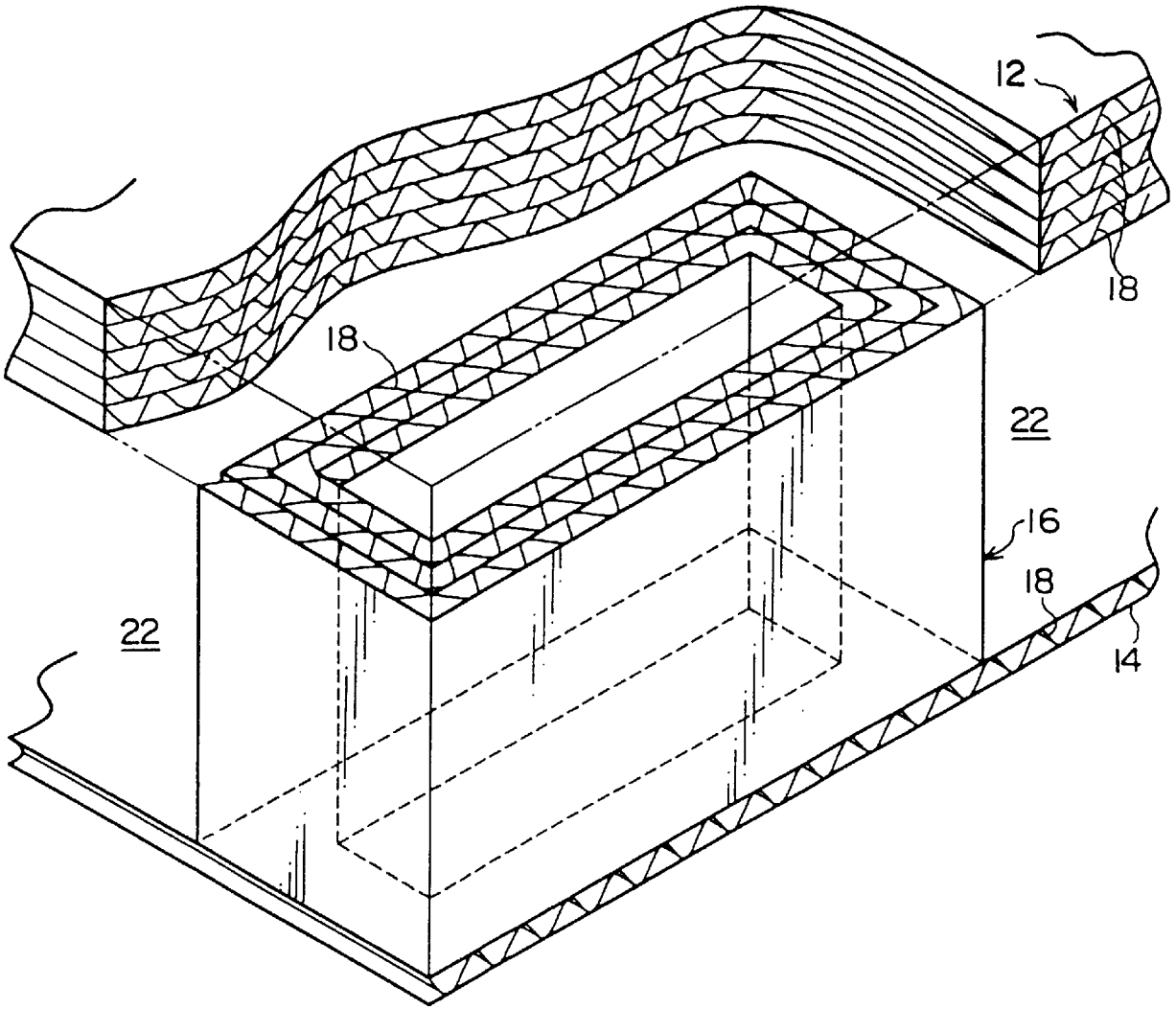
FIG. 2 is a perspective view showing a cross section of a portion of a pallet according to the first embodiment of the present invention.

As is shown in detail in FIG. 2, a loading tray 12 is formed from a plurality of sheets of corrugated fiberboard 18, formed in the same shape, which are stacked side against side and then bonded using a bonding material such as a general adhesive. In the present embodiment, five sheets of corrugated fiberboard 18 are used to form the loading tray 12, however, the present invention is not limited to this and, providing that the weight of the load unit 114 (the combined weight of the stacks 112), which is loaded onto the loading tray 12, and the weight of the intermediate packaging material 124 and the external packaging material 116, which are described later, can be supported, then even one sheet of corrugated fiberboard may be used. However, it is preferable that more sheets of corrugated fiberboard are used for the loading tray 12 than for the base plate 14 in order to securely support the weight. Further, it is not absolutely necessary for the shape of the sheets of corrugated fiberboard 18 forming the loading tray 12 to be identical, and the loading tray 12 may be formed from layers of corrugated fiberboard 18 whose shape is only the same every second layer.

As is shown in FIG. 1, the width W1 and length L1 of the loading tray 12 are each set at a predetermined size so as to be slightly larger than the load unit 114 after the load unit 114 has been packaged with the external packaging material 116. More specifically, the accumulating apparatus 320 is set so that the width W1 and length L1 of the loading tray 12 have the following relation to the width W and length L of the load unit 114 (see FIG. 3) and the thickness D of the external packaging 116 (see FIG. 4):

$$W1>W+2D \quad (1)$$

$$L1>L+2D \quad (2)$$

Accordingly, as is shown in FIG. 4, when the periphery of the load unit 114 loaded on the loading tray 12 is externally packaged with the external packaging material 116, the vicinity of the outer edge of the loading tray 12 extends beyond the load unit 114. This extending portion is the extending portion 20 of the present invention. Note that when there is no need to form the extending portion 20, then the following relationship may be followed:

$$W1=W+2D \quad (1)'$$

$$L1=L+2D \quad (2)'$$

In FIG. 2, the sheets of corrugated fiberboard 18 are layered so that the directions of the waves in the center of each sheet of fiberboard 18 are all running in the same direction. However, the direction of the waves in the center of each sheet of fiberboard is not particularly limited and the sheets of fiberboard may be layered so that, for example, at least one of the sheets of fiberboard 18 has the center waves thereof running in a direction intersecting (which may include the orthogonal direction) the direction of the center waves of the other sheets of fiberboard. By layering the sheets of fiberboard 18 so that the directions of the waves in the center of each sheet intersect each other, there is no weakness in the strength of the loading tray 12 in a particular direction. Moreover, by reducing the directionality of the strength (i.e., unevenness in the directionality) in this way, when the pallet 10 is supported by the forks of a forklift being inserted in the insert body receiving member 22 (described later), the forks are able to be inserted from any direction to support the pallet 10.

The leg portions 16 are formed in a four cornered spiral shape by bending an elongated sheet of corrugated board 18 at right angles at predetermined positions in a uniform direction. The leg portions 10 as a whole are thus formed into four sided cylinders open at the top and bottom thereof. Note that the shape of the leg portions 16 is not limited to this and may be in a block shape or a long string-like shape. However, using some type of cylindrical shape (there is no particular restriction on the shape of the cylinder and, in addition to the above four sided cylinder, any hollow cylindrical shape such as round cylinders and three sided cylinders may be used) allows the weight to be kept light, due to the hollow center, and the amount of corrugated fiberboard 18 needed to form a leg portion 16 (i.e. the length of the elongated corrugated fiberboard 18 before it is formed into the leg portion 16) to be reduced. Moreover, this type of cylindrical shape enables the strength required to support the weight of the stack of photosensitive printing plates 112 via the loading tray 12 to be maintained.

Even if the leg portions 16 are formed using a four sided cylinder structure, the cylinder is not limited to one formed in the above spiral shape, however, forming the cylinder in a spiral shape means that the leg portion 16 can be formed from a single piece of corrugated fiberboard 18 which reduces the number of parts and simplifies the forming of the leg portion 16.

The leg portion 16 are disposed with a predetermined spacing between each leg portion. An insertion hole (insertion body receiving member) 22 is formed between adjacent leg members 16, the loading tray 12 and the base plate 14. This insertion hole 22 is formed in a predetermined shape so that a fork of the forklift for transporting the pallet 10 can be inserted therein.

The base plate 14 is formed from corrugated fiberboard in substantially the same shape as the corrugated fiberboard forming the loading tray 12. There are no particular restrictions on the number of sheets of corrugated fiberboard forming the base plate 14 and a plurality of sheets may be stacked side to side in layers, however, the base plate 14 of the present embodiment is formed from one sheet of corrugated fiberboard.

The loading tray 12, is bonded to the leg portions 16 and the leg portions 16 to the base plate 14 by a bonding agent such as a general adhesive so that there is no inadvertent separation or shifting in the positions between the portions. Moreover, the leg portions 16 are fixed on two sides by the loading tray 12 and the base plate 14 and are also connected to each other via the loading tray 12 and base plate 14 so that the loading tray 12 can be reliably supported when a load is loaded thereon.

Next an explanation will be given of the method used for loading and packaging (intermediate and external packaging) stacks of photosensitive printing plates 112 on a pallet 10 according to the first embodiment, and of the working of the pallet 10.

Firstly, a pallet 10 is set at a predetermined position in the accumulating apparatus 320 on the photosensitive printing plate production line 310 shown in FIG. 13. The outline of the pallet 10 is larger than the outline of a load unit 114 formed from stacks of photosensitive printing plates 112, however, because the difference in size is slight, the pallet can be set directly without having to alter the structure or shape of the accumulating apparatus 320.

Next, as is shown in FIG. 3, lower intermediate packaging material 124A is placed substantially centrally over the top surface of the loading tray 12. This lower intermediate packaging material 124A is made from moisture proof and light proof paper and is larger than the bottom surface of the load unit 114. The lower intermediate packaging material 124A may be simply placed on top of the loading tray 12, however, it is preferable if it is fastened thereto by an adhesive agent or by adhesive tape.

When the production line 310 is set in operation, stacks of photosensitive printing plates 112 are loaded directly onto the pallet 10 to form a load unit 114. Because the lower intermediate packaging material 124A is larger than the bottom surface of the load unit 114 the outer edge portions of the lower intermediate packaging material 124A extend beyond the load unit 114. Because the load unit 114 is formed in this way by loading stacks of photosensitive printing plates 112 directly onto the pallet 10, there is no need to temporarily accumulate the stacks of photosensitive printing plates 112 from the accumulating apparatus on a separate pallet and then load them again onto the pallet 10, which allows the task of accumulation to be performed more efficiently.

After a load unit 114 has been formed by loading stacks 112 onto the loading tray 12, the extending portion of the lower intermediate packaging material 124A is bent up against the load unit 114 and is placed in surface contact with the side surfaces (the front surface 114A, the rear surface 114B, and the side surfaces 114C) of the load unit 114. Thus the bottom surface and a portion of the side surfaces (or all of the side surfaces) of the load unit 114 are intermediately packaged.

Upper intermediate packaging material 124B is placed substantially centrally on the top surface of the load unit 114. This upper intermediate packaging material 124B is made from the same paper material as the lower intermediate packaging material 124A, and is of a predetermined size so that, when the portion extending out past the top surface of the load unit 114 is bent down to be in surface contact with the side surfaces of the load unit 114, it partially overlaps the lower intermediate packaging material 124A.

As is shown in FIG. 4, after the upper intermediate packaging material 124B has been bent down, the overlapping portions of the upper intermediate packaging material 124A and lower intermediate packaging material 124B are fastened around the entire periphery of the load unit 114 by adhesive tape 126. Thus, the load unit 114 is completely wrapped in the intermediate packaging material 124 (i.e. the upper intermediate packaging material 124A and lower intermediate packaging material 124B) and is made completely moisture proof and light proof. Namely, in view of the nature of a photosensitive printing plate, it is necessary to shield it from light because it is sensitive to light in the visible wavelength band. Moreover, even if heat sensitive printing plates are used instead of photosensitive printing plates, because changes in the sensitivity thereof may occur due to deterioration of the heat sensitive layer or reaction progression caused by the thermal energy of light striking the heat sensitive printing plates, it is preferable that appropriate light shading is carried out. Moreover, in conditions of high humidity, problems such as the photosensitive layer or heat sensitive layer of the respective printing plates deteriorating and the sensitivity changing, or the backing paper 330 adhering to adjacent printing plates easily occur, therefore it is necessary to moisture proof the plates. Accordingly, as described above, because the photosensitive printing plates (or heat sensitive printing plates) are made completely moisture proof and light proof by the intermediate packaging material 124, all the above problems are solved. Note that either the lower intermediate packaging material 124A or the upper intermediate packaging material 124B may be on the outside at the point where the two materials overlap.

In this way, the load unit 114 is intermediately packaged with the intermediate packaging material 124, and with the load unit 114 in a completely moisture proof state, the forks of a forklift are inserted into the insertion holes 22 formed between leg portions 16 of the pallet 10, then with the stacks 112 loaded on the loading tray 12, the pallet 10 is removed from the production line 310. At this time, if the loading tray 12 has been constructed so that the direction of the waves inside at least one sheet of corrugated fiberboard 18 intersect the direction of the waves inside the other sheets of corrugated fiberboard, the directionality of the strength (unevenness in the direction) of the corrugated fiberboard is reduced allowing the forks to be inserted to support the pallet 10 from any direction. Note that the pallet 10 with the load unit 114 loaded thereon may be intermediately packaged after being removed from the production line 310. In this case, the load unit 114 comprising loaded stacks of photosensitive printing plates 112 may be formed after the lower intermediate packaging material 124A has been spread on the loading tray 12 externally of the production line 310.

Figure 5:
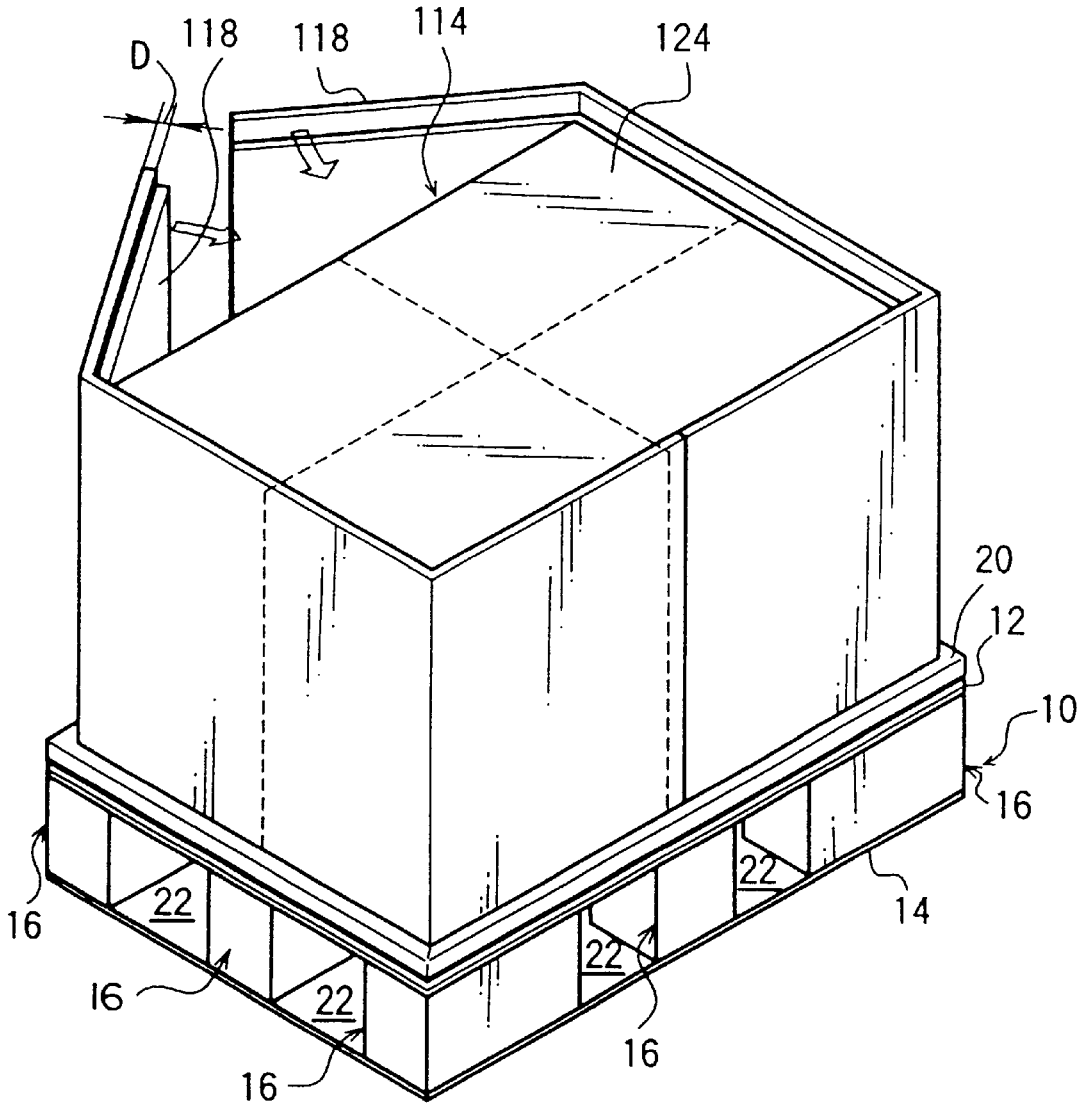
FIG. 5 is a perspective view showing a load unit which has been loaded on a pallet according to the first embodiment of the present invention and externally packaged.

Next, as is shown in FIG. 5, the periphery of the load unit 114 is externally wrapped with external packaging material 116. In the present embodiment, the external packaging material 116 is formed from a pair of side surface external packaging materials 118 each comprising two sheets of corrugated fiberboard 18 adhered together and a top surface external packaging material 128 also comprising two sheets of corrugated fiberboard adhered together. The inner side corrugated fiberboard of the two sheets of corrugated fiberboard which form each side surface external packaging material is substantially the same height as the load unit 114. The outer side corrugated fiberboard is higher than the inner side corrugated fiberboard by the height of the thickness of the top surface external packaging material 128. Note that it is not absolutely necessary to form the side surface external packaging material and top surface external packaging material from two sheets of corrugated fiberboard adhered together, and three or more sheets may be adhered together or only one sheet may be used. Moreover, it is not absolutely necessary that the sheets be adhered together.

The pair of side surface external packaging materials 118 are placed in surface contact with the front surface 114A and the rear surface 114B of the load unit 114 (see FIG. 3 for both) intermediately packaged with the intermediate packaging material 124 and the portions which extend beyond the sides of the load unit 114 in the widthwise direction thereof are bent and set in surface contact with the side surfaces 114C of the load unit 114 (see FIG. 3). At this time, because the loading tray 12 has been formed larger than the load unit 114 in accordance with the above formulas (1) and (2), the bottom edge of the side surface external packaging material 116 is positioned by being aligned with the portion of the top surface of the loading tray 12 which extends outwards past the load unit 114 allowing the external packaging task to be easily carried out.

Figure 6:
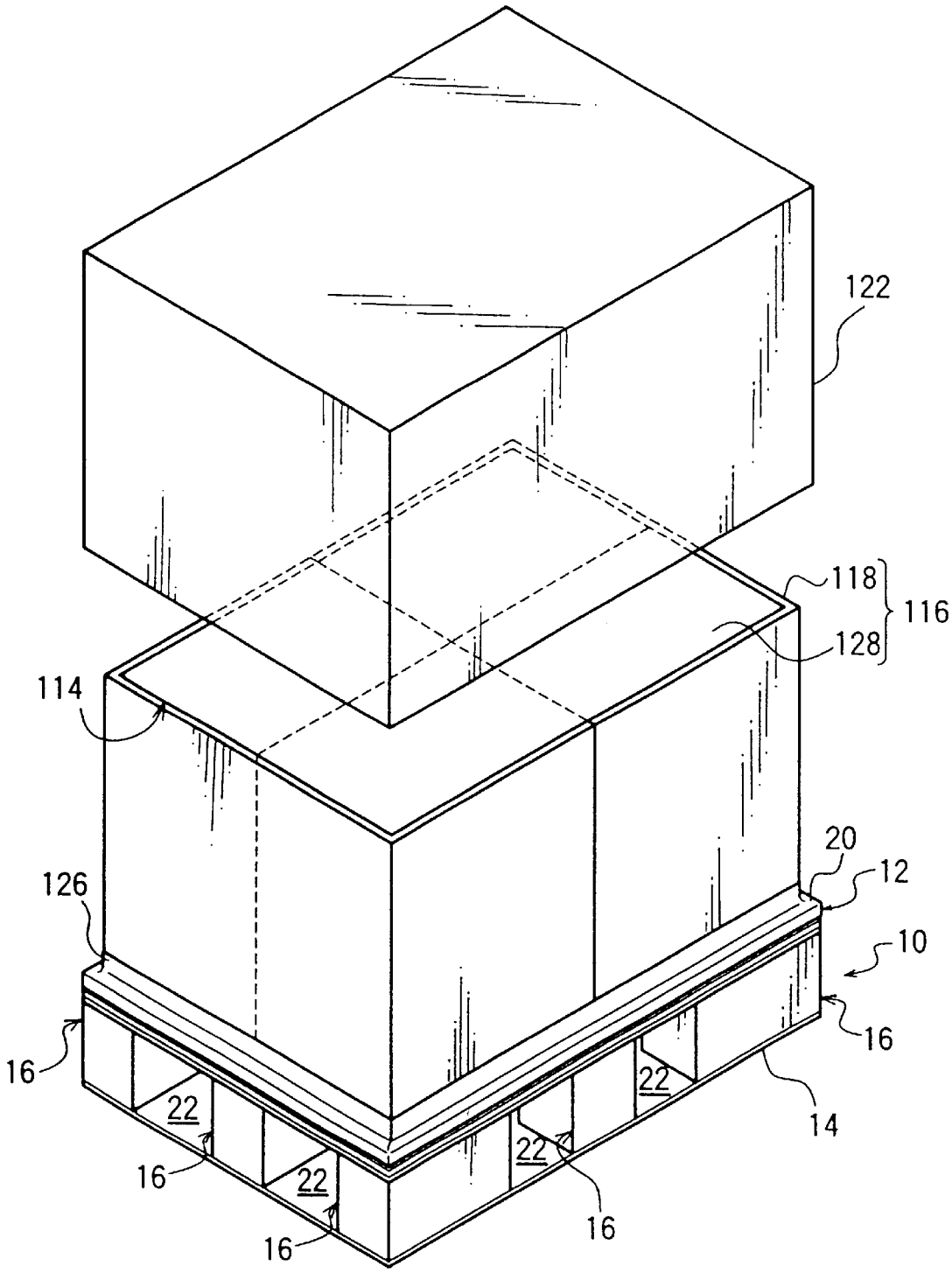
FIG. 6 is a perspective view showing a load unit which has been loaded on a pallet according to the first embodiment of the present invention and a cover which has been fitted over the external packaging material.

As is shown in FIG. 6, the top surface of the load unit 114 is covered by a top surface external packaging material 128. The top surface external packaging material 128 has a predetermined shape so as to fit exactly inside the outer sheet of corrugated fiberboard which forms the side surface external packaging material 118. Accordingly, the top surface external packaging material 128 is disposed in contact with the top surface of the load unit 114 and the top side of the inner sheet of corrugated fiberboard forming the side surface external packaging material 118. The side surface external packaging material 118 is then fixed to the loading tray 12 and to the top surface external packaging material 128 with adhesive tape 126. Thus, the top surface external packaging material 128 and the side surface external packaging material 118 are joined together forming the external packaging material 116.

Note that the relationship between the shape and height of the side surface external packaging material 118 and the shape and thickness of the top surface external packaging material 128 is not limited to the above. For example, the height of the corrugated fiberboard forming the side surface external packaging material 118 may be the same as the height of the intermediately wrapped load unit 114 and the thickness of the top surface external packaging material 128 added together (when the side surface external packaging material 118 is formed from a plurality of sheets of corrugated fiberboard, the height of all the sheets of corrugated fiberboard is set as the same), and the top surface external packaging material 128 is then placed on the top surface of the intermediately packaged load unit 114 on the inside of the side surface external packaging material 118. Further, the height of the corrugated fiberboard forming the side surface external packaging material 118 may be set at the same height as the intermediately packaged load unit 114 (when the side surface external packaging material 118 is formed from a plurality of sheets of corrugated fiberboard, the height of all the sheets of corrugated fiberboard is set as the same), and the top surface external packaging material 128 placed on top of both the top side of the side surface external packaging material 118 and the top surface of the intermediately packaged load unit 114. When the side surface external packaging material 118 and the top surface external packaging material 128 are formed by having a plurality of sheets of corrugated fiberboard placed side to side in layers, the height of the sheets of corrugated fiberboard forming the side surface external packaging material 118 can be increased continuously from the inner side to the outer side so that the top sides of the side surface external packaging material 118 have a stepped configuration. The top surface external packaging material 128 may also be formed to match the shape of the top sides of the side surface external packaging material by being formed in a stepped configuration, namely, where the size of the top surface external packaging material continually increases going from the bottom towards the top thereof. The top surface external packaging material 128 is then placed on the top surface of the load unit 114 in such a way that the side surface external packaging material 118 and the top surface external packaging material 128 contact each other such that the stepped portions of each fit together.

Note also that it is not necessary for the side surface external packaging material 118 to be formed in two separate sections, as described above and, provided that the external surface of the intermediately packaged load unit 114 is externally packaged, the shape and structure of the external packaging material is not particularly limited. For example, four sheets of side surface external packaging material may be formed so that they each cover a side of the external surface of the load unit 114 and then disposed at the external surfaces of the load unit 114. Alternatively, the four sheets of side surface external packaging material may be formed in advance into a four sided cylinder which is then fitted around the load unit 114 from the top thereof. It is also possible to adjust the size of the side surface external packaging material 118 so that a predetermined gap is formed between the side surface external packaging material and the intermediately packaged load unit 114, and to insert a new separate external packaging material (such as a cushioning material) into the gap after the side surface external packaging material has already been put in place.

Thereafter, the periphery of the external packaging 116 is packaged with a resin cover 122. This protects the external packaging material 116 and the stacks 12 (the photosensitive printing plates) from moisture and dust in the air and from rain and the like. Note that if the stacks 112 (the photosensitive printing plates) are sure to be protected from moisture and dust in the atmosphere and from rain and the like by the intermediate packaging material 124 and the external packaging material 116, then the cover 122 is not required.

Figure 7:
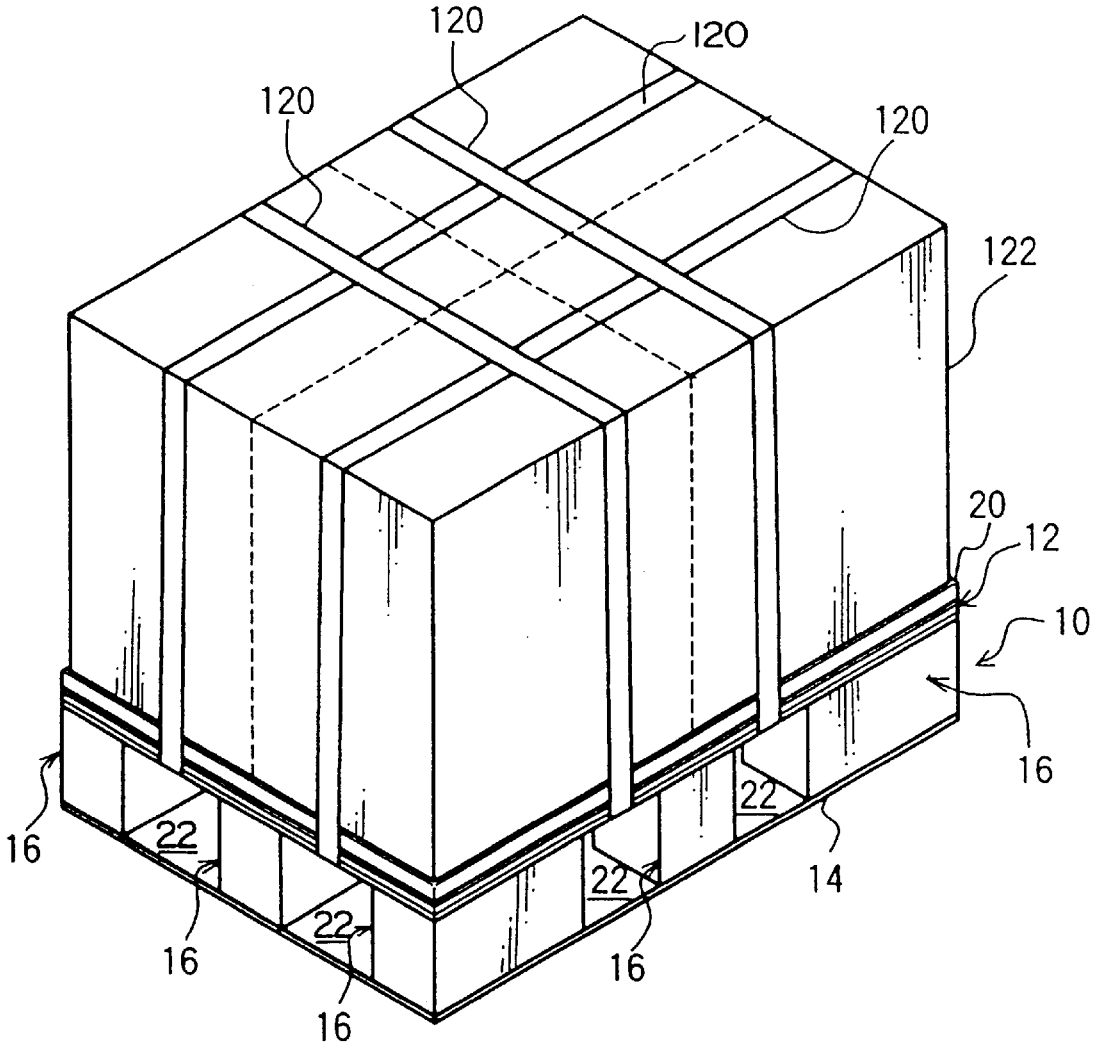
FIG. 7 is a perspective view showing a load unit which has been loaded onto a pallet according to the first embodiment of the present invention and external packaging fastened with a band.

Lastly, as is shown in FIG. 7, the load unit 114 which is packaged by the cover 122 and external packaging material 116 and the pallet 10 are fastened by resin or metal bands 120 (In FIG. 7, two lengthwise and two widthwise bands have been used, however, the number of bands is not limited to two and three or more may be used). This prevents the stacks of photosensitive printing plates 112 from shifting position or falling over on the pallet 10 and enables handling during transport or storage to be carried out with ease. Note that the cover 122 may be put in place after the external packaging material 116 and the pallet 10 have been fastened by the bands 120.

In this way, because stacks of photosensitive printing plates 112 are loaded on a pallet 10 to form a load unit 114 and are fastened to the pallet 10, if they are reloaded onto another transporting means while being transported (for example, if they are loaded from a truck onto another truck, railcar, ship, or the like), the entire pallet and load can be reloaded which leads to excellent operating efficiency. Moreover, because, in this state, the peripheral portions of the loading tray 12 extend beyond the load unit 114 and the external packaging material 116 to form the extending portion 20, even if external elements strike against the pallet 10 during transportation, the external element is prevented from striking against the stacks 112 by the extending portion 20, thus protecting the photosensitive printing plates. In particular, the photosensitive printing plates or heat sensitive printing plates loaded onto the pallet 10 of the present embodiment are all formed in the shape of a thin plate, therefore, if there is any deformation or scratching on the corners, sides or inner portions, then problems may occur such as the image being blurred when the plates are developed by heat or light sensitivity, or the ink not being spread uniformly during printing. Accordingly, the packaging material needs to have a rigidity and strength sufficient to prevent the printing plates from being deformed and the like during transportation. By transporting the printing plates loaded on the pallets 10 of the present embodiment, the above deformation and scratching can be prevented.

A plurality of pallets 10 on which are loaded load units 114 can be stacked vertically one on top of the other. In this case, the base plate 14 of the pallet 10 makes surface contact with the top surface external packaging material 128 directly beneath the pallet 10 and the leg portions 16 do not directly touch the top surface external packaging material 128. Namely, because the weight of a pallet 10 and load unit 114 acts on the entire top surface of the load unit 114 underneath thus spreading the weight, the load unit 114 is protected. A plurality of pallets 10 loaded with load units 114 can also be lined up side by side, front to rear, and vertically, and thus be loaded onto a separate larger pallet.

When the photosensitive printing plates are loaded into an apparatus at their destination and used, the bands 120 are unfastened (if fitted, the cover 122 is also removed), and the external packaging 116 is opened. Because the loading tray 12 of the pallet 10 is formed slightly larger than the load unit 114, the stacks 112 can be set directly in the device while still loaded on the pallet 10. Naturally, the stacks 112 may also be removed from the pallet 10 and set in the apparatus. Note that, in order to set the stacks directly in the apparatus in this way, the loading tray 12 may also be made the same size as the load unit 114 or made smaller than the load unit 114.

When all the stacks of photosensitive printing plates 112 loaded on the pallet 10 are loaded into the apparatus, only the pallet 10 remains. If the pallet 10 has retained a constant shape and strength, it may be reused, however, even if it is not capable of being reused, because the loading tray 12, leg portions 16, and base portion 14 which form the pallet 10 are all made from corrugated fiberboard, they can be recycled. Disposal of waste is also easy.

Note that it is not necessary for the lower intermediate packaging material 124A to be large enough to extend out beyond the load unit 114, and it may be substantially the same size as the load unit 114. In this case, the upper intermediate packaging material 124B is made large enough to reach the loading tray 12 and is fixed to the top surface (i.e. portion formed as the extending portion 20) or peripheral surface of the loading tray 12 with adhesive tape forming intermediate packaging having a high level of moisture proofness. In addition, the lower intermediate packaging material 124A may be omitted providing intermediate packaging having a general level of moisture proofness.

Figure 8:
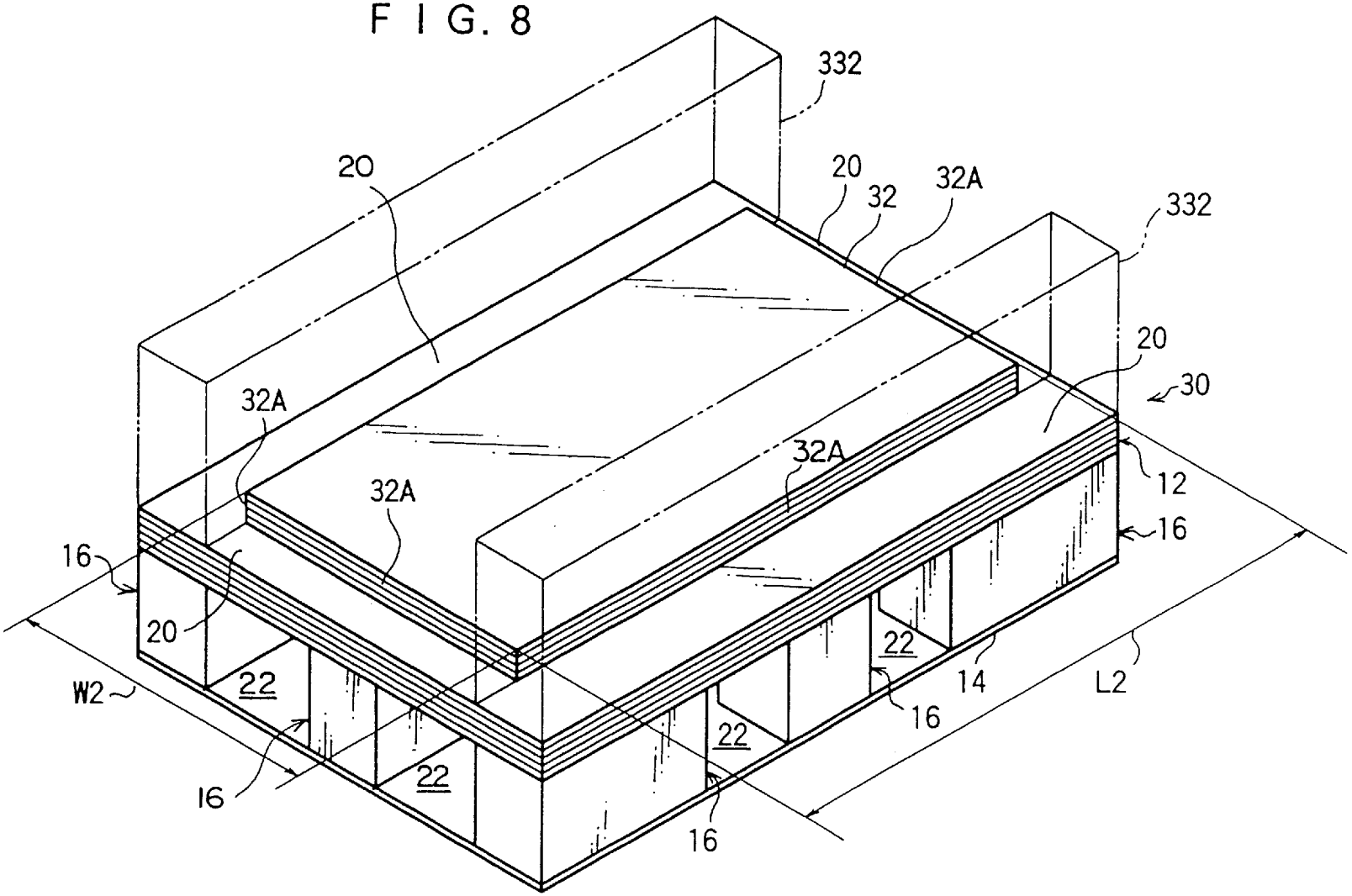
FIG. 8 is a perspective view showing a pallet according to the second embodiment of the present invention.
Figure 9:
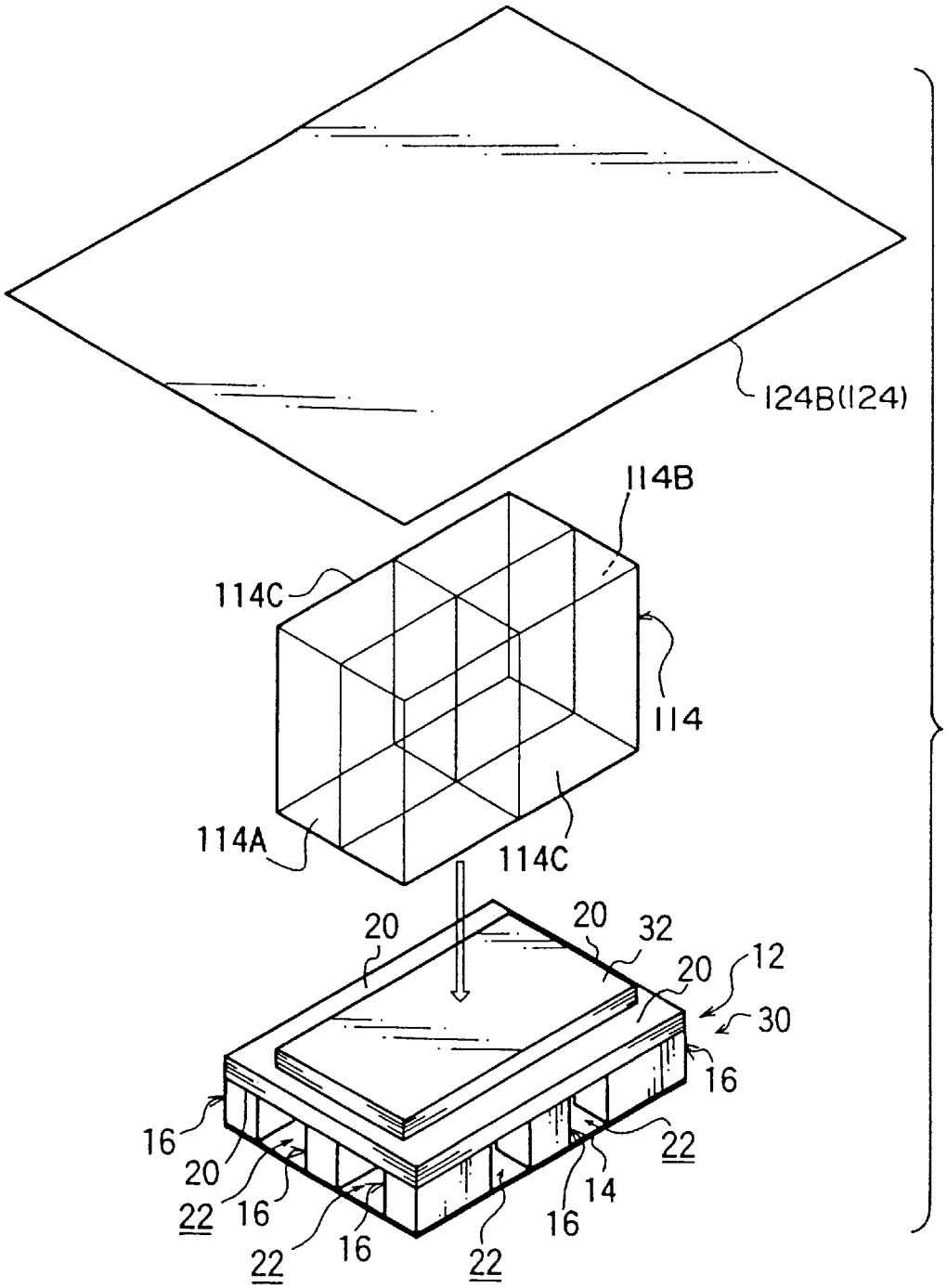
FIG. 9 is a perspective view showing a pallet according to the second embodiment of the present invention and intermediate packaging material and a load unit loaded onto this pallet.

FIG. 8 shows a pallet 30 according to the second embodiment of the present invention. In this pallet 30, only the structure of the loading member onto which is loaded a load unit 114 is different to the pallet 10 of the first embodiment. In the explanation below, the same structural elements and members as in the pallet 10 of the first embodiment are given the same symbols and an explanation thereof is omitted.

The loading tray 12 of the pallet 30 of the second embodiment has the same structure as the loading tray 12 of the first embodiment, however, it is further provided with a step portion 32 formed in the center portion of the loading tray 12 from a plurality of sheets of corrugated fiberboard loaded side to side on top of each other. The width W2 and length L2 of the step portion 32 are made the same as the width W and length L of the load unit 114 (see FIG. 3). A loading member is formed from the load plate 12 and step 32.

When stacks 112 are accumulated on the pallet 30, a positioning guide 332 provided in the accumulating device 320 on the production line 310 (see FIG. 13) is placed in contact with the peripheral portions 32A of the step 32 (shown by the double dot-dash line in FIG. 8). The height of the positioning guide 332 is higher than the height of the step 32, therefore, when a stack 112 is placed on the step 32, the stack 112 is positioned by being guided by the positioning guide 332. Note that it is also possible to provide positioning guides 332 at both ends of the pallet 30 in the longitudinal direction thereof.

Moreover, unlike the first embodiment, the stack 112 is placed directly on the step 32 without using the lower intermediate packaging material 124A (see FIG. 3). When a load unit 114 has been formed from a predetermined number of stacks 112, the upper intermediate packaging material 124B is placed on the top surface of the load unit 114. The upper intermediate packaging material of the second embodiment 124B is made to a predetermined size so that when the portions of the upper intermediate packaging material 124B which extend out past the top surface of the load unit 114 are bent down so as to be in surface contact with the side surfaces of the load unit 114 (the front surface 114A, the rear surface 114B, and the side surfaces 114C), these portions reach the peripheral portions 32A of the step portion 32.

The upper intermediate packaging material 124B and the peripheral portions 32A of the step portion 32 are fastened together with adhesive tape around the entire periphery of the load unit 114. The step portion 32 is formed to a predetermined size so that the width W2 and length L2 thereof are the same as the width W and length L of the of the load unit 114. Thus, because the external surfaces of the load unit 114 and the peripheral portions 32A of the step portion 32 are flush with each other, the upper intermediate packaging material 124B can be placed in surface contact with both and the intermediate packaging process is simplified. If the upper intermediate packaging material 124B is given sufficient length the bottom edge thereof can even be placed in contact with the top surface of the loading tray 12 simplifying the intermediate packaging process still further. Because the load unit 114 is contained inside the upper intermediate packaging material 124B in unbroken surface contact with the inner surface thereof, the load unit 114 is securely fixed to the pallet 30. Note that the upper intermediate packaging material 124B may also be fixed to the top surface or peripheral surfaces of the loading tray 12 with adhesive tape 126.

The load unit 114 is thus placed in a state of high moisture proofness by being packaged with the intermediate packaging material 124 in this way and the pallet 30 and load unit 114 are then removed from the production line. Note that, in the same way as in the first embodiment, the pallet 30 with the load unit 114 loaded thereon may be intermediately packaged after being removed from the production line 310. In this case, the load unit 114 is formed externally of the production line 310 after the lower intermediate packaging material 124A has been spread on the loading tray 12.

Also in the same way as in the first embodiment, the load unit 114 may be externally packaged using the external packaging material 116. At this time, because the lower side of the side surface external packaging material 118 can be disposed in surface contact with the peripheral portions of the step portion 32, the lower side of the side surface external packaging material 118 can be securely fixed to the step 32 and there is no inadvertent shifting in the position thereof. Further, in the same way as in the first embodiment, by using bands 120 and a cover 122, the stacks 112 can not only be fixed more firmly to the pallet 30, but the printing plates can be securely protected from moisture and dust in the atmosphere and rain and the like.

Moreover, because, in this state, the outer edge portion of the loading tray 12 forms an extending portion 20 which extends out past the load unit 114 and the external packaging material 116, protection of the load unit 114 can be ensured.

Note that, in the second embodiment, in the same way as the first embodiment, the lower intermediate packaging material 124A is placed on the step 32. The portion thereof extending out past the load unit 114 is then bent up and the portion thereof which overlaps with the upper intermediate packaging material 124B is fastened thereto with adhesive tape 126 providing complete moisture proof protection.

Figure 10:
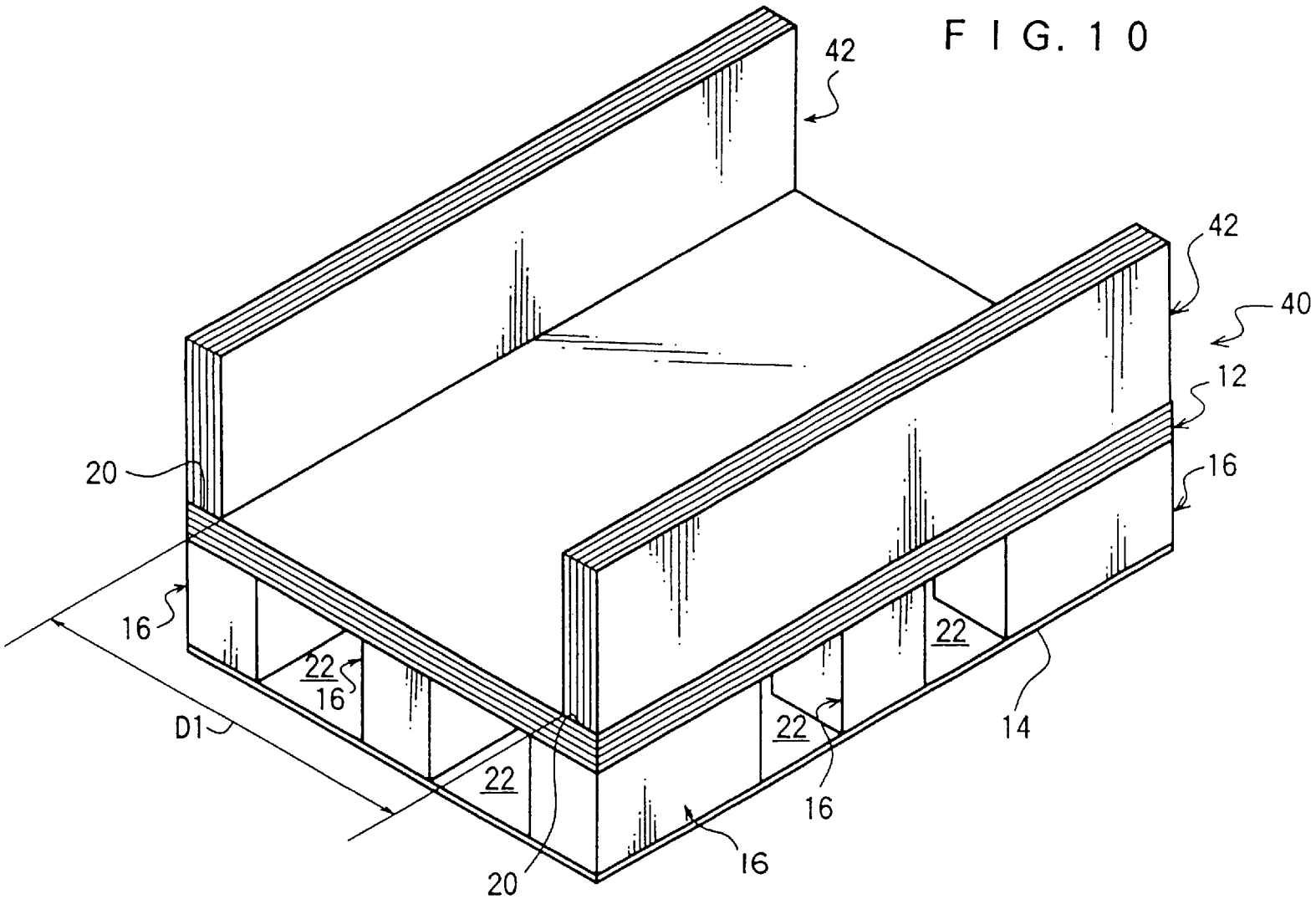
FIG. 10 is a perspective view showing a pallet according to the third embodiment of the present invention.

FIG. 10 shows a pallet 40 according to the third embodiment of the present invention. Only the structure of the loading member is different from the pallet 10 of the first embodiment. The same structural elements and members as in the pallet 10 of the first embodiment are given the same symbols and an explanation thereof is omitted.

In the pallet 40 of the third embodiment, a pair of fixed boards 42 are provided standing vertically upright from each edge in the transverse direction of the loading tray 12. The loading member is formed from the loading tray 12 and the fixed boards 42. The spacing D1 between the fixed boards 42 is found by the following formula which takes into consideration the width W of the load unit 114 and the depth D of the intermediate packaging 124 and external packaging 116.

$$D1=W+2D \tag{3}$$

Accordingly, when a load unit 114 is loaded onto the loading tray 12, the portion where the fixed boards 42 are provided (the vicinity of both transverse edges) and the fixed boards 42 form the extending portion 20 extending out past the load unit 114.

When stacks of photosensitive printing plates 112 fed from the production line 310 (see FIG. 13) are loaded onto the pallet 40, because the stacks fed onto the loading tray 12 are positioned by the fixed boards 42, the task of accumulating the stacks is simplified.

After the stacks have been accumulated, then, in the same way as in the first embodiment, the load unit 114 is made completely moisture proof by being packaged with the intermediate packaging material 124 (the lower intermediate packaging material 124A and the upper intermediate packaging material 124B). Because the vicinity of both transverse edges of the loading tray 12 and the fixed boards 42 operate as the extending portion 20 extending out past the stacks 112, the stacks are protected by the extending portion 20.

When the stacks 112 are externally packaged using the external packaging 116 (see FIG. 4), because the spacing D1 between the fixed boards 42 is set in accordance with the above formula (3), the stacks can be externally packaged in such a way that the external packaging material 116 fits between the stacks 112 and the fixed boards 42. The result of this is that the external packaging material 116 is held from the outside by the fixed boards 42 and does not shift in position. By further fastening the external packaging material 116 to the fixed boards 42 using adhesive tape 126, the external packaging material 116 can be securely fixed to the pallet 40. In the same way as in the first embodiment, using the bands 120 and the cover 122 enables the stacks 112 to be even more firmly fastened to the pallet 40.

Note that it is also possible to provide fixed boards in the same way as the fixed boards 42 at both longitudinal ends of the loading tray 12. In this case, the spacing D2 between the fixed boards may be set in accordance with the formula below, which takes into consideration the length L of the load unit 114 and the depth D of the external packaging 116.

$$D2=L+2D \tag{4}$$

The intermediate packaging is not limited to the completely moisture proof packaging described above, and the lower intermediate packaging 124A may be high moisture proof intermediate packaging being substantially the same size as the bottom surface of the load unit 114, or general moisture proof intermediate packaging being smaller than the bottom surface of the load unit 114.

Figure 11:
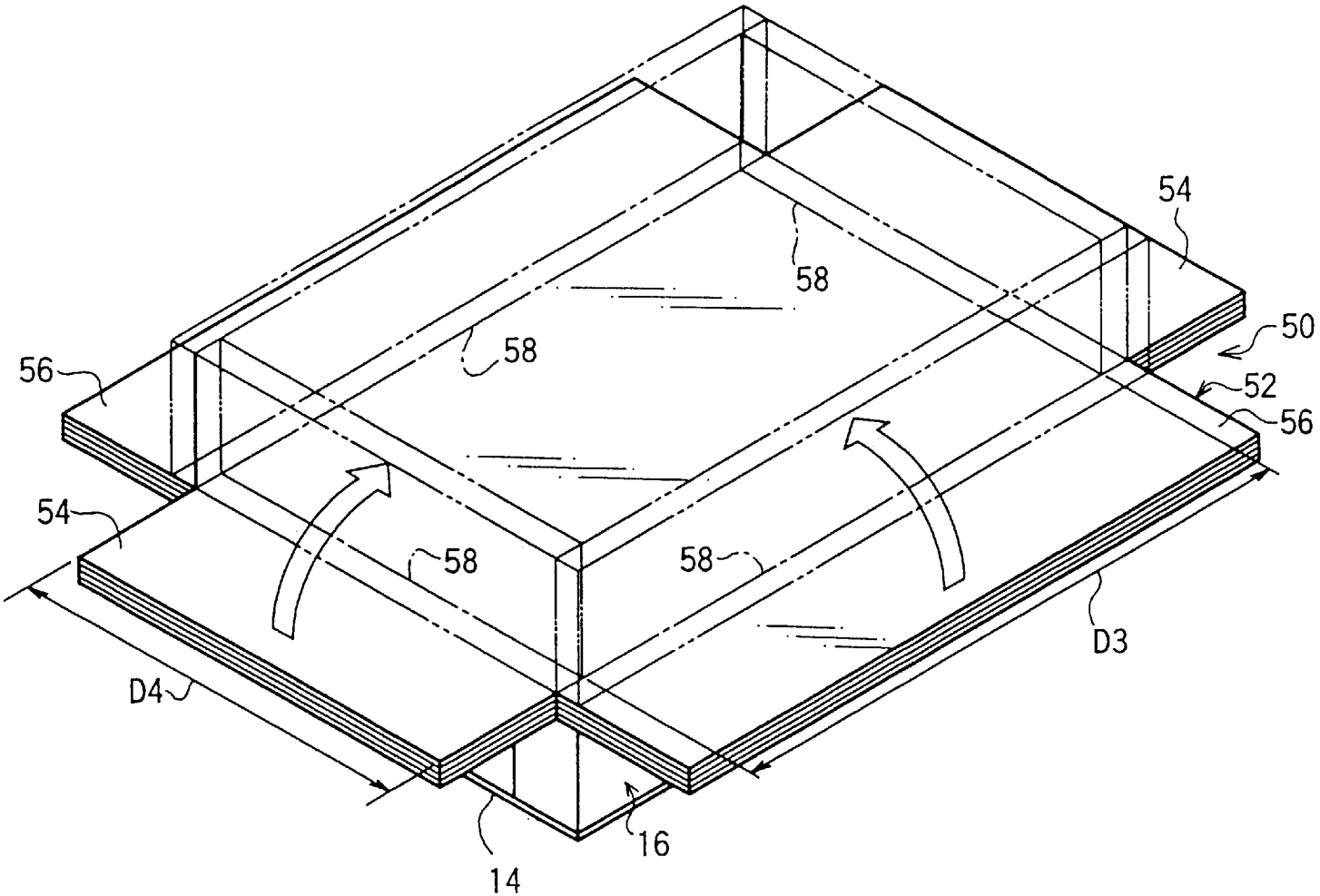
FIG. 11 is a perspective view showing a pallet according to the fourth embodiment of the present invention.

FIG. 11 shows a pallet 50 according to the fourth embodiment of the present invention. In this pallet 50 only the structure of the loading member differs from the pallet 10 of the first embodiment and the same structural elements and members as in the pallet 10 of the first embodiment are given the same symbols below and a description thereof is omitted.

In the pallet 50 of the fourth embodiment, extending boards 54 and 56 extend outwards from both longitudinal edges and both transverse edges of the loading tray 52. Bend lines 58 are formed in the border portions between the loading tray 52 and the extending boards 54 and 56 (the single dot-dash lines in FIG. 11) enabling the extending boards 54 and 56 to be bent upwards (and, accordingly, making the area inside the bend lines 58 act as the actual loading tray). The spacing D3 of the extending board 54 when the extending boards 54 and 56 are bent 90 degrees upwards along the bend lines 58 is set in accordance with the following formula with the length of the load unit 114 taken as L, the width thereof taken as W, and the depth of the external packaging taken as D, in the same way as for the pallet 10 of the first embodiment.

$$D3=L+2D \tag{5}$$

In the same way, the spacing D4 of the extending board 56 is set in accordance with the following formula:

$$D4=W+2D \tag{6}$$

Note that the structure of the bend lines 58 is not specifically limited providing that the extending boards 54 and 56 are able to be bent upwards. For example, notches may be cut from the bottom side of the loading tray 52 creating thin portions at which the extending boards can be easily bent.

When stacks 112 are loaded on the pallet 50 forming a load unit 114 to be intermediately packaged, the stacks 112 are first loaded onto the loading tray 52 to form a load unit 114 (see FIG. 3) before the extending boards 54 and 56 have been bent upwards. After the load unit 114 has been loaded on the loading tray 52, the load unit 114 is intermediately packaged with intermediate packaging material 124 (i.e. lower intermediate packaging material 124A and upper intermediate packaging material 124B) in the same way as in the first embodiment. This intermediate packaging may be either complete moisture proofing, high level moisture proofing, or general moisture proofing.

After the load unit 114 has been externally packaged in a predetermined position by the external packaging material, the extending boards 54 and 56 are bent along the bend lines 58, as shown by the double dot-dash lines in FIG. 8, so as to be in surface contact with the side surfaces 114C (see FIG. 3) of the load unit 114. Because the width of the thickness of the extending boards 54 and 56 thus becomes the extending portion extending out past the load unit 114 and external packaging material 116, the load unit 114 is protected. Moreover, because the external packaging material 116 is externally held by the extending boards 54 and 56, there is no shifting in the position of the external packaging material 116. If the external packaging material 116 is further fastened to the extending boards 54 and 56 with adhesive tape 126, the external packaging material 116 is securely fixed to the pallet 50. As in the first embodiment, the use of bands 120 and a cover 122 enables the stacks 112 to be fixed more firmly to the pallet 50.

Note that it is possible to provide only the extending boards 54 and not the extending boards 56 in the pallet 50 or, conversely, to provide only the extending boards 56 and not the extending boards 54. The shape of the extending boards 54 and 56 is also not limited to that described above and the length of the extending boards 56 may be made the same as the length L of the load unit 114. In addition, the length of the extending boards 54 may be made the same as the width W of the load unit 114.

It is also possible to first bend the extending boards 54 and 56 upwards at 90 degrees or almost 90 degrees (i.e. on a slope) and then load the stacks 112. In this case, because the stacks 112 are positioned by the extending boards 54 and 56 or by the bend lines 58, the task of loading is simplified.

Figure 12:
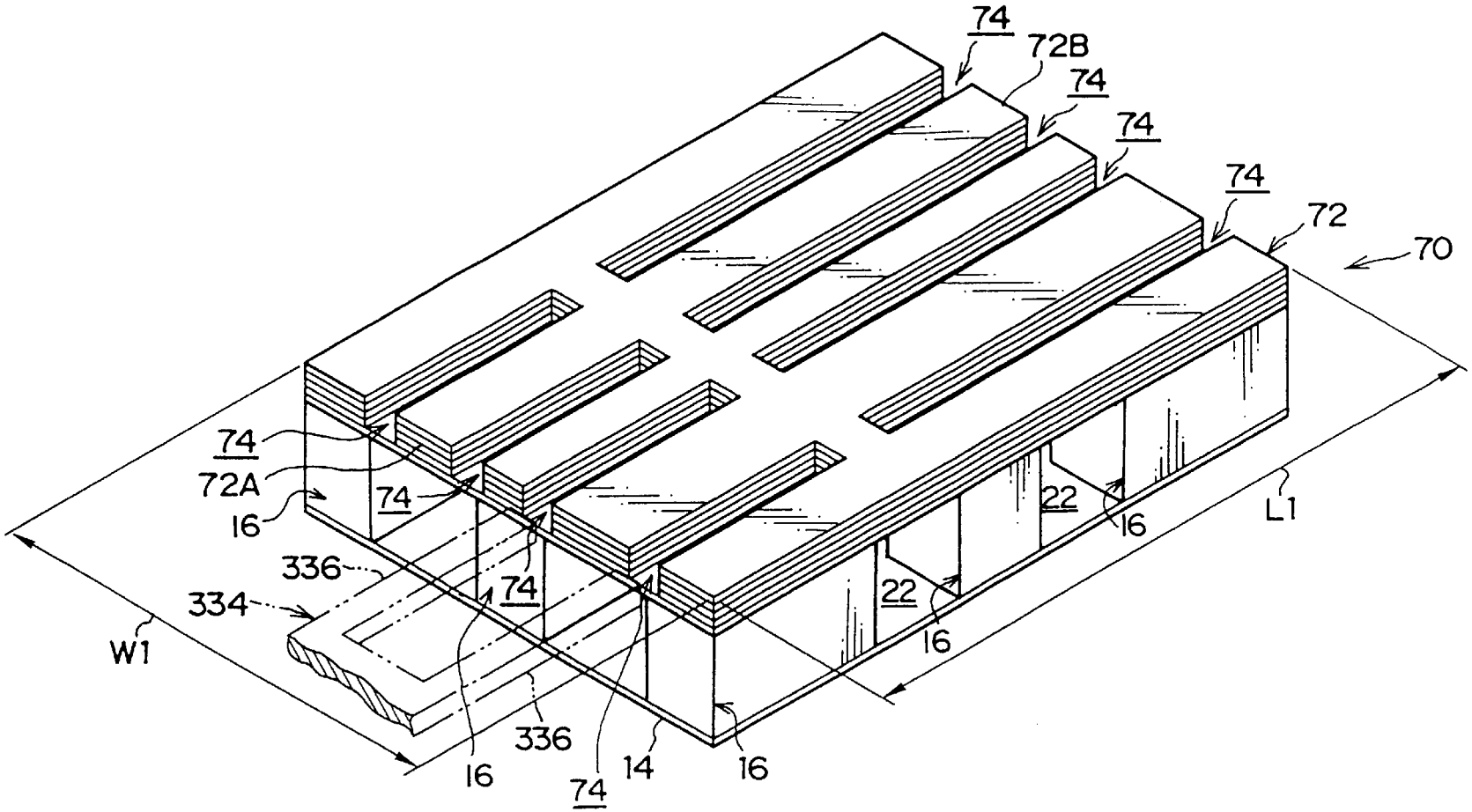
FIG. 12 is a perspective view showing a pallet according to the fifth embodiment of the present invention.

FIG. 12 shows a pallet 70 according to the fifth embodiment of the present invention. In the pallet 70, only the structure of the loading member differs from that of the pallet 10 of the first embodiment and the same structural elements and members as in the pallet 10 of the first embodiment are given the same symbols and a description thereof is omitted.

The size of the loading tray 72 of the pallet 70 of the fifth embodiment is formed in accordance with the above described formulas (1) and (2), in the same way as the pallet 10 of the first embodiment.

A plurality of housing portions 74 having a uniform width are formed in both longitudinal ends of a loading tray 72 running longitudinally towards the center thereof (in the present embodiment, there are four in the front surface 72A and four in the rear surface 72B, making a total of eight). The housing portions 74 in the front surface 72A of the loading tray 72 are open at the top and at the front surface 72A. Similarly, the housing portions 74 in the rear surface 72B of the loading tray 72 are open at the top and at the rear surface 72B.

The position and shape of each of the housing portions 74 is determined so as to correspond to accumulating arms 334 provided in the accumulating apparatus 320 on the production line 310 (see FIG. 13). Namely, as is shown in FIG. 12, an accumulating arm 334 having a plurality of forks 336 (two in FIG. 12) is provided in the accumulating apparatus 320, and after the photosensitive printing plates are produced they are accumulated and positioned on the accumulating arm 334. When a stack 112 is formed by accumulating a predetermined number of photosensitive printing plates, the accumulating arm 334 is moved so that the stack 112 is loaded on the loading tray 72 of the pallet 70. At this time, because the housing portion 74 is open at the top thereof, and the forks 336 of the accumulating arm 334 are housed in the housing section 74, the forks 336 do not become caught between the stack 112 and the loading tray 72.

Moreover, because the housing portions 74 are open the at the front surface 72A and rear surface 72B of the loading tray 72, after a stack 112 has been loaded onto the loading tray 72, the forks 336 can be removed from the housing portions 74.

In the same manner as for the pallet 10 of the first embodiment, a load unit 114 is formed on the loading tray 72 of the pallet 70 which can be intermediately packaged and externally packaged with the intermediate packaging material 124 and external packaging material 116. However, the task of accumulating stacks 112 is made even easier in particular because, as explained above, the stacks 112 of photosensitive printing plates are loaded on the loading tray 72 while loaded on the forks 336 of the accumulating arm 334, and the forks 336 can be removed from the housing portions 74 without the need for any further action. Note that not only the forks 336 of the accumulating arm 334, but even the forks of a forklift can be prevented from being caught between the stacks 112 and the loading tray 72 and also removed from the housing portions 74.

The peripheral edge portions of the loading tray 72 act as the extending portions 20 extending out beyond the load unit 114 (see FIG. 4) thereby protecting the photosensitive printing plates forming the stacks 112. However, as with the pallet 10 of the first embodiment, it is not absolutely necessary to provide the extending portion 20.

Note also that, in the examples given in the above descriptions, corrugated fiberboard was used to form all of the structural members forming a pallet (i.e., the loading trays 12, 52, and 72, the base plate 14, the leg portions 16, the step portion 42, and the fixed plate 42), however, the paper used to form these structural members is not limited to corrugated fiberboard. Namely, provided that the paper can maintain a constant shape and the strength necessary as a pallet to support a load, and can be easily recycled or disposed of, then any paper can be used. For example, cardboard, Kraft paper, or a paper honeycomb structure material may all be used. Alternatively, appropriate combinations of these types of paper can be used, or else a different type of paper may be used for each structural member. In any case, the use of paper to form the structural members provides lighter weight pallets which are easier to handle during transport or storage compared to conventional metal or resin pallets. Moreover, by manufacturing the pallets from paper, they can be produced cheaply. Note that even if paper other than corrugated fiberboard is used to form the loading tray, by superposing a plurality of sheets of paper with the direction of the grain of at least one sheet intersecting the direction of the grains of the other sheets, the directionality of the strength of the paper (variations in the strength of the paper depending on the direction) can be reduced and the pallet can be supported no matter which direction the forks are inserted from.

When corrugated fiberboard is used for each structural element, it is preferable from the viewpoint of maintaining a uniform strength and the like, that the following conditions are met.

The most preferable type of flute of the corrugated fiberboard is a BA flute or AB flute, followed in order by an A flute, a B flute, and a C flute. The most preferable type of liner for the front and rear liner of the corrugated fiberboard is AA liner, followed by A liner, B liner, and C liner. The basic weight of the front and rear liners is from 160 ($g/m^2$) to 340 ($g/m^2$). The most preferable type of ruffled inner layer of the corrugated fiberboard is a strengthened ruffled inner layer, followed by an A ruffled inner layer, a B ruffled inner layer, and a C ruffled inner layer. The basic weight of the ruffled inner layer is from 115 ($g/m^2$) to 280 ($g/m^2$)./

If a honeycomb structure material is used instead of the corrugated fiberboard, it is preferable that the same front liner, rear liner, and center as for the above corrugated fiberboard are used.

If cardboard is used instead of the corrugated fiberboard, it is preferable that the basic weight thereof is from 600 ($g/m^2$) to 2000 ($g/m^2$).

Further, provided that each of the above structural elements are disposed so as not to separate accidentally or change position relative to each other, it is not absolutely necessary for them to be fastened together through the adhesion of an adhesive agent or adhesive tape. For example, the loading tray 12 and leg portion 16 can be fixed so as not to separate or shift position by forming an engaging portion or fitting portion in the loading tray 12 and leg portion 16 and engaging or fitting these portions together. The lower intermediate packaging material 124A and the upper intermediate packaging material 124B may be adhered together using an adhesive agent as may the external packaging material 116 and the loading tray 12.

Naturally, the load loaded onto the pallet of the present invention is not limited to a load unit 114 formed from a stack 112 of photosensitive printing plates as described above and the load unit 114 may be formed from a stack 112 of a wide range of general printing plates, including heat sensitive printing plates and the like.

A specific example of a load unit containing printing plates (photosensitive printing plates and heat sensitive printing plates) is given below.

Firstly, an aluminum plate measuring 0.3 mm×1310 mm×1050 mm on which is coated a photosensitive or heat sensitive layer may be used as the printing plate.

Backing paper 330 made from bleached Kraft pulp having a basic weight Of 30~45 $g/m^2$, a density of 0.7~0.85 $g/cm^3$, a water content of 4~6%, a Beck smoothness of 50~200 seconds, and a pH of 4~6 may be used as the backing paper 330. This backing paper 330 is then closely adhered to the coating layer (photosensitive or heat sensitive) on the aluminum plate and between 10 and 100 printing plates and backing paper are alternately superposed. Protective cardboard manufactured from wastepaper and having a basic weight of 400~1500 $g/m^2$, a density of 0.7~0.85 $g/cm^3$, a water content of 4~8%, a Beck smoothness of 3~20 seconds, and a pH of 4~6 is then disposed below and above the superposed materials forming a product stack 112. When a stack 112 is formed of between 10~100 printing plates, the facing sides of the protective cardboard and the printing plates may be held with Kraft adhesive tape in two places each so that they do not shift against each other.

The light proof, moisture proof paper (alumikraft paper) which can be used for the intermediate packaging material 124 may be one in which 6 $\mu$m aluminum foil is adhered to a Kraft paper obtained from 13 $\mu$m low density polyethylene and having a basic weight of 85 $g/m^2$. The stacks 112 are intermediately packaged using this light proof, moisture proof paper and are then made fast using adhesive tape 126. The light proof, moisture proof paper is not, however, limited to the above example and, for example, a light proof, moisture proof paper, provided by further adhering a 10–70 $\mu$m low density polyethylene layer to the aluminum foil whose structure was described above, may be used.

The stacks 112 are also not limited to those described above. For example, the stacks may have no backing paper, alternatively, the stacks may contain up to a maximum of 1500 superposed printing plates with the above described protective cardboard inserted between every 20~100 plates, or the stacks 112 may also be formed from up to a maximum of 1500 printing plates with the protective cardboard only provided above and below the stack 112.

It is also not necessary to form the external packaging material 116 from the above described corrugated fiberboard and, provided that they are capable of protecting the load unit 114 from external shocks, then, for example, cardboard, Kraft paper, and honeycomb structure paper materials may be used as external packaging for the load unit 114. From the above viewpoint, by using a material having a high degree of rigidity such as paper hardboard or the like, as the outermost member of the external packaging 116, so that even if the energy from a strong shock is applied to the external packaging material 116, the external packaging material 116 is not deformed and the load unit 114 can be more effectively protected. In the same way, by using an elastic material, for example, such as foam resin, for the innermost member of the external packaging material (the member in contact with the intermediate packaging material 124), the energy from a strong shock can be absorbed by the elastic deformation of this elastic material and the load unit 114 can be more effectively protected.

What is claimed is:

1. A load packaging method for loading a load on a loading member of a pallet and intermediately packaging the load with intermediate packaging material, wherein the pallet comprises:

a loading member made from paper onto which a load is loaded;

a leg member made from paper which is fixed to the loading member and, as well as supporting the loading member when a load is loaded on the loading member, forms an insert body receiving member into which is inserted an insert body used during transportation; and a base member made from paper which is fixed to the opposite side of the leg member to the loading member, wherein the load packaging method comprises:

a load loading step for loading the load onto the loading member;

an intermediate packaging step for intermediately packaging the top surface and side surfaces of the load loaded onto the loading member with the intermediate packaging material, wherein said intermediate packaging step includes placing an upper intermediate packaging material substantially centrally on the top surface of the load and bending down a portion which extends out past the top surface of the load so as to be in surface contact with the side surfaces of the load; and a fastening step for fastening the intermediate packaging material with which the load was intermediately packaged in the intermediate packaging step to the loading member.

2. A load packaging method for loading a load on a loading member of a pallet and intermediately packaging the load with intermediate packaging material, wherein the pallet comprises:

a loading member made from paper onto which a load is loaded;

a leg member made from paper which is fixed to the loading member and, as well as supporting the loading member when a load is loaded on the loading member, forms an insert body receiving member into which is inserted an insert body used during transportation; and a base member made from paper which is fixed to the opposite side of the leg member to the loading member, wherein the load packaging method comprises:

a load loading step for loading the load onto the loading member;

an intermediate packaging step for intermediately packaging the top surface and side surfaces of the load loaded onto the loading member with the intermediate packaging material; and a fastening step for fastening the intermediate packaging material with which the load was intermediately packaged in the intermediate packaging step to the loading member, wherein, before the step to load a load on the loading member, a laying step is performed to lay intermediate packaging material, which is substantially the same shape as the loading member, on the loading member.

3. The load packaging method according to claim 2, wherein the loading member includes a step portion and wherein, in the step to load the load on the loading member, the side surfaces of the load and side portions of the step portion are made flush, and in the intermediate packaging step, the intermediate packaging material is placed in surface contact with both the side surfaces of the load and the side portions of the step portion.

4. A load packaging method for loading a load on a loading member of a pallet and intermediately packaging the load with intermediate packaging material, wherein the pallet comprises:

a loading member made from paper onto which a load is loaded;

a leg member made from paper which is fixed to the loading member and, as well as supporting the loading member when a load is loaded on the loading member, forms an insert body receiving member into which is inserted an insert body used during transportation; and a base member made from paper which is fixed to the opposite side of the leg member to the loading member, wherein the load packaging method comprises:

a load loading step for loading the load onto the loading member;

an intermediate packaging step for intermediately packaging the top surface and side surfaces of the load loaded onto the loading member with the intermediate packaging material; and a fastening step for fastening the intermediate packaging material with which the load was intermediately packaged in the intermediate packaging step to the loading member, further comprising:

a laying step for laying a lower intermediate packaging material formed to a larger size than the loading member on the loading member;

a lower intermediate packaging step for loading a load onto the lower intermediate packaging material laid in the laying step and for bending upwards portions of the lower intermediate packaging material which extend out beyond the load thus intermediately packaging the bottom surface and a portion of or all of the side surfaces of the load; and a fastening step for intermediately packaging the top surface and side surfaces of the load loaded onto the loading member with an upper intermediate packaging material and fastening the upper intermediate packaging material to the lower intermediate packaging material.

5. The load packaging method according to claim 4, wherein in the laying step, lower intermediate packaging material is laid while the extending portion is not bent, and in the lower intermediate packaging step, the lower intermediate packaging material and the extending portion are bent upwards.

6. A load packaging method for loading a load on a loading member of a pallet and intermediately packaging the load with intermediate packaging material, wherein the pallet comprises:

a loading member made from paper onto which a load is loaded;

a leg member made from paper which is fixed to the loading member and, as well as supporting the loading member when a load is loaded on the loading member, forms an insert body receiving member into which is inserted an insert body used during transportation; and a base member made from paper which is fixed to the opposite side of the leg member to the loading member, wherein the load packaging method comprises:

a load loading step for loading the load onto the loading member;

an intermediate packaging step for intermediately packaging the top surface and side surfaces of the load loaded onto the loading member with the intermediate packaging material; and a fastening step for fastening the intermediate packaging material with which the load was intermediately packaged in the intermediate packaging step to the loading member, wherein the loading member includes a step portion and wherein, in the step to load the load on the loading member, the side surfaces of the load and side portions of the step portion are made flush, and in the intermediate packaging step, the intermediate packaging material is placed in surface contact with both the side surfaces of the load and the side portions of the step portion.

* * * * *